United States Patent [19]

Harby

[11] Patent Number: 4,804,137

[45] Date of Patent: Feb. 14, 1989

[54] FOOD CONTAINER

[76] Inventor: Colin F. Harby, 609 S. Belnord Ave., Baltimore, Md. 21224

[21] Appl. No.: 131,737

[22] Filed: Dec. 11, 1987

[51] Int. Cl.[4] ..... B65D 5/20; B65D 21/04

[52] U.S. Cl. ..... 229/114; 220/23.4; 229/120; 229/125.28; 229/125.29; 229/DIG. 14; 229/906

[58] Field of Search ..... 220/23.2, 23.4; 229/120.01, 120.11, 114, 120, 901, 902, 903, 906, 125.19, 125.28, 125.29, DIG. 8, DIG. 14, 23 R, 23 BT; 219/10.55 E; 426/107, 113, 114, 122, 123

[56] References Cited

U.S. PATENT DOCUMENTS

| | | | |
|---|---|---|---|
| 713,624 | 11/1902 | Ferres | 229/125.19 |
| 1,649,591 | 11/1927 | Honigbaum | 229/125.29 |
| 1,913,597 | 6/1933 | Jones | 229/125.19 |
| 2,361,344 | 10/1944 | Yates | 229/DIG. 14 |
| 2,917,218 | 12/1959 | Guyer | 229/901 |
| 3,027,062 | 3/1962 | Huss et al. | 229/901 |
| 3,108,569 | 10/1963 | Kundikoft | 229/120 |
| 3,176,900 | 4/1965 | Cigavenko | 229/125.19 |
| 3,447,672 | 6/1969 | Bailey et al. | 229/125.28 |
| 3,507,443 | 4/1970 | Gerard | 229/DIG. 14 |
| 3,863,832 | 2/1975 | Gordon et al. | 229/125.35 |
| 4,470,538 | 9/1984 | Heathcock et al. | 229/125.29 |
| 4,487,319 | 12/1984 | Barrash | 229/120.11 |

FOREIGN PATENT DOCUMENTS

| | | | |
|---|---|---|---|
| 752178 | 1/1970 | Belgium | 220/23.4 |
| 1354605 | 1/1964 | France | 229/DIG. 14 |
| 2428581 | 2/1980 | France | 229/DIG. 14 |
| 2444624 | 8/1980 | France | 220/23.4 |
| 248674 | 3/1926 | United Kingdom | 229/125.29 |

*Primary Examiner*—Jimmy G. Foster
*Assistant Examiner*—Gary E. Elkins
*Attorney, Agent, or Firm*—Colin F. Harby

[57] ABSTRACT

Disclosed is a container for packaging foods and particular frozen foods. The container includes a bottom tray and a like tray which has been inverted and turned 90 degrees to form a lid or cover for the bottom tray.

The tray is formed from a thermoplastic coated paperboard blank having a base portion, a plurality of cut and scored lines forming opposing upstanding walls when folded, and bonding panels extending from upper or lower edges of one pair of opposing upstanding walls. A cohesive emulsion is used on the bonding panels to secure the bottom tray to the lid.

The substantially identical cover and bottom tray can be made utilizing convential machinery and from various substrates including plastics. Other features of the container include vents for allowing release of pressure during heating and upwardly diverging walls allowing nesting. Another embodiment includes a compartmented container having multiple bottom trays and a single continuous cover unit.

6 Claims, 17 Drawing Sheets

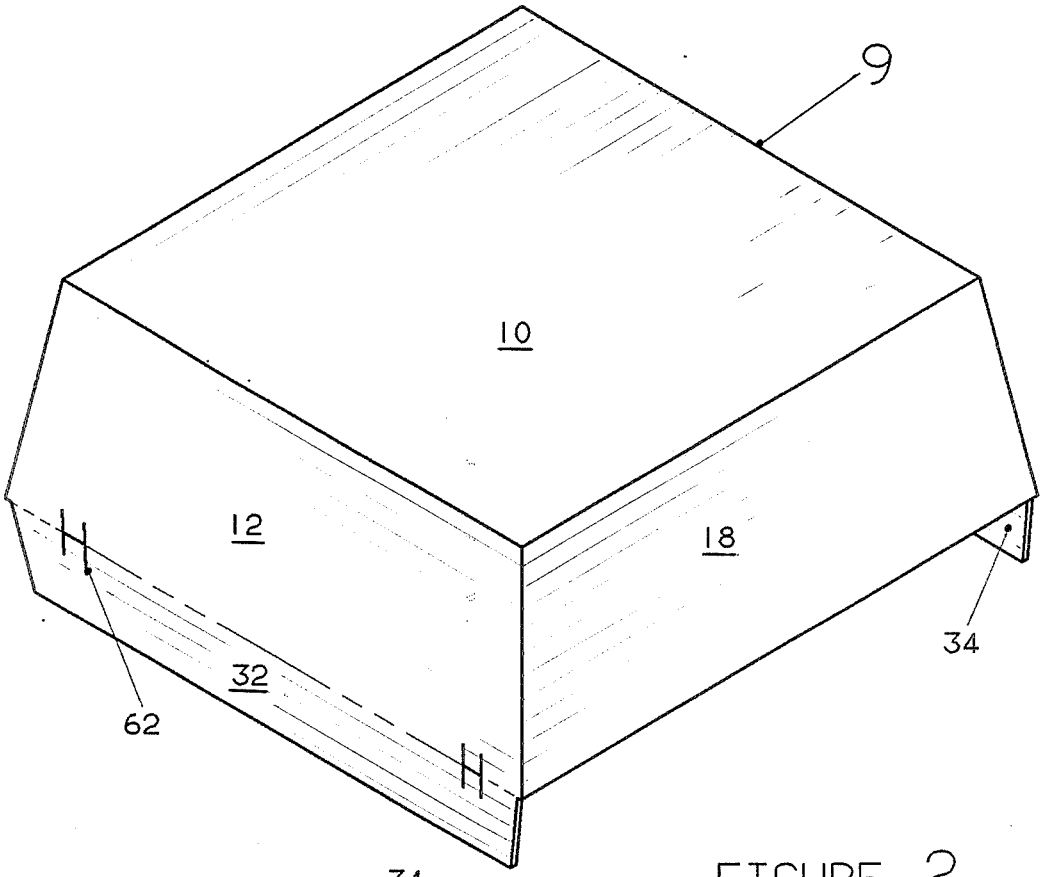
FIGURE 2
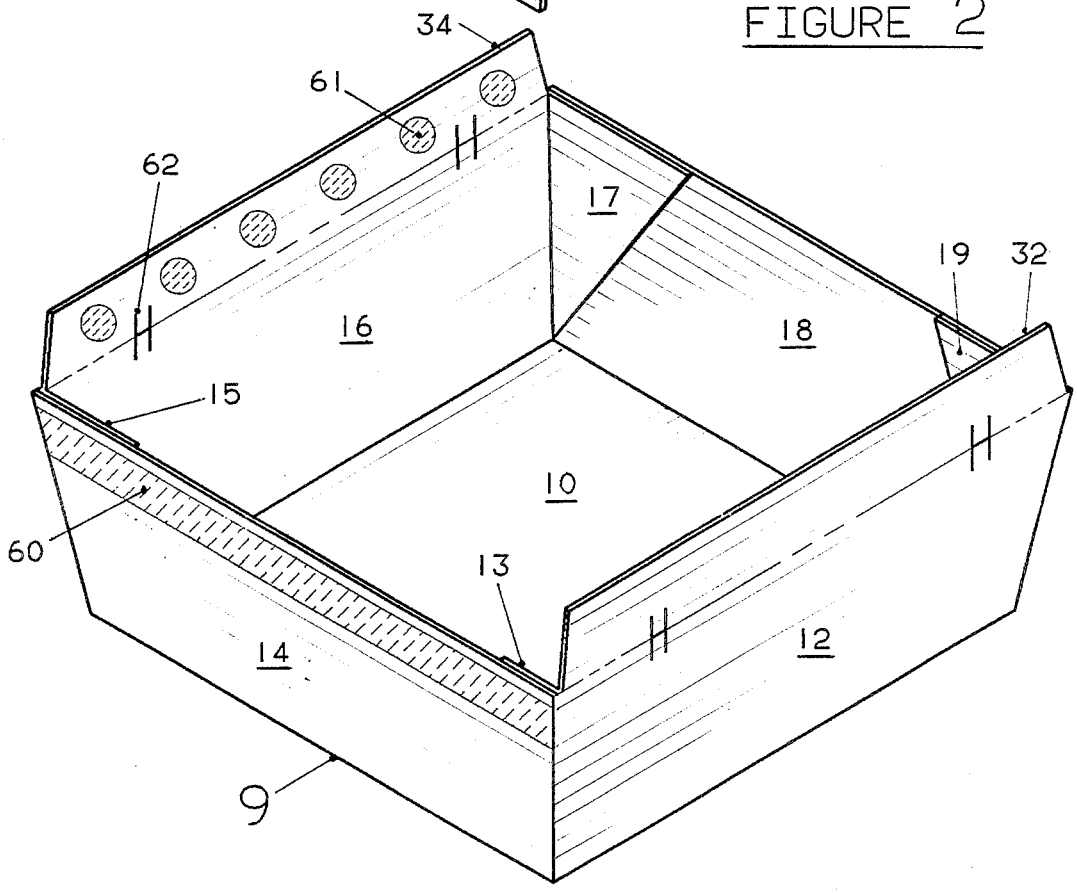

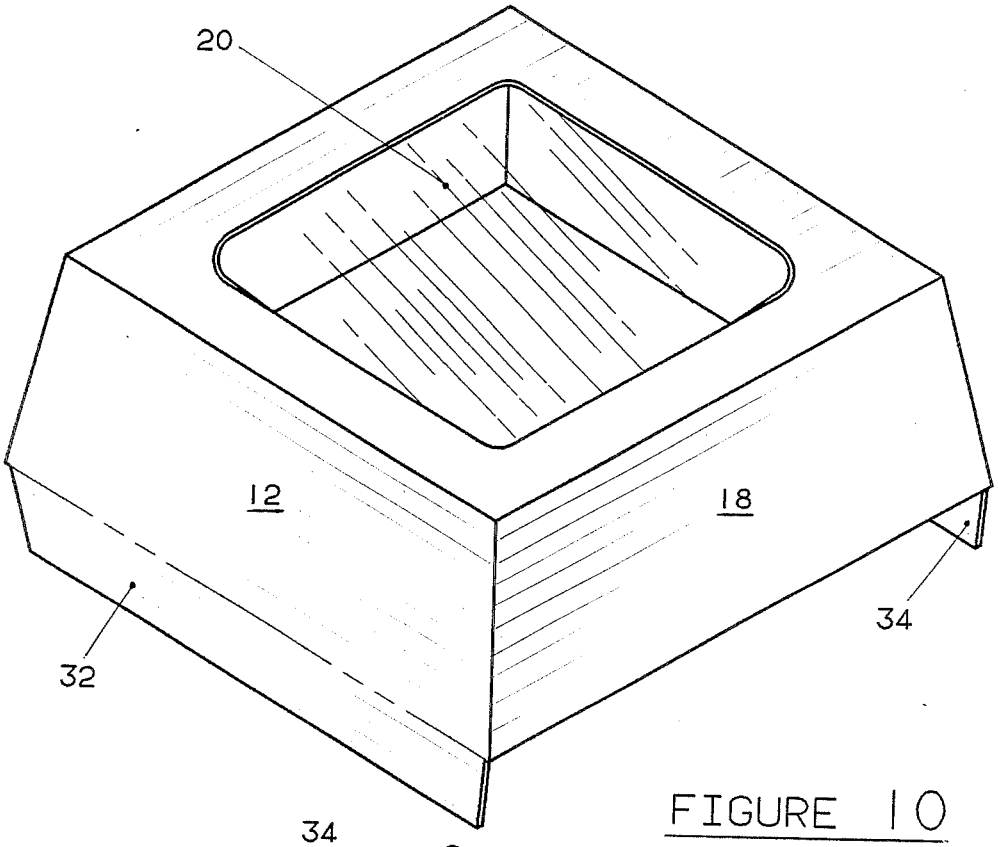
FIGURE 10
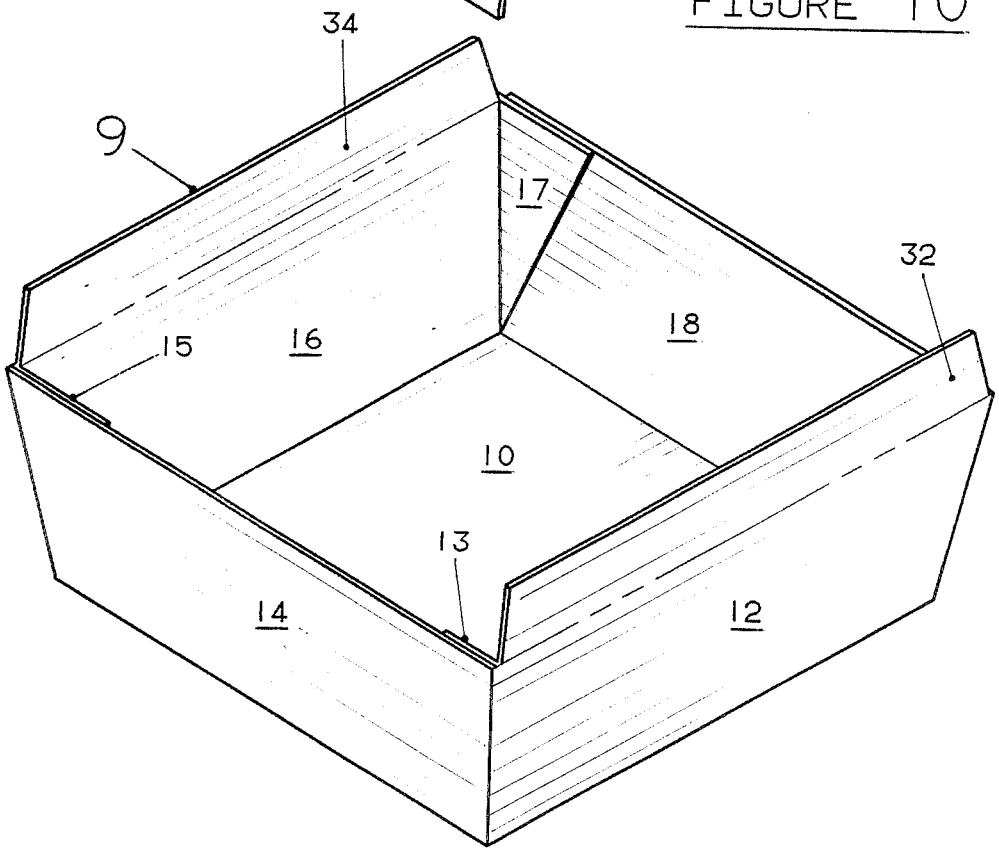

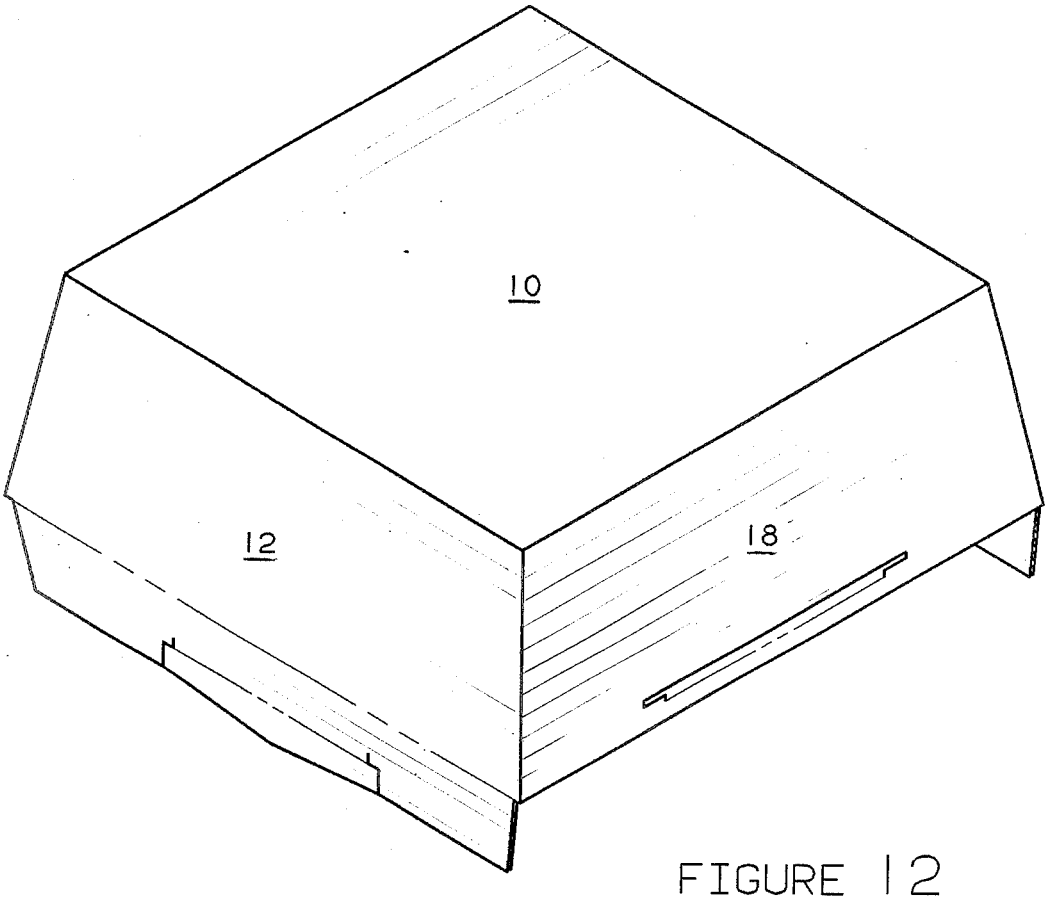
FIGURE 12
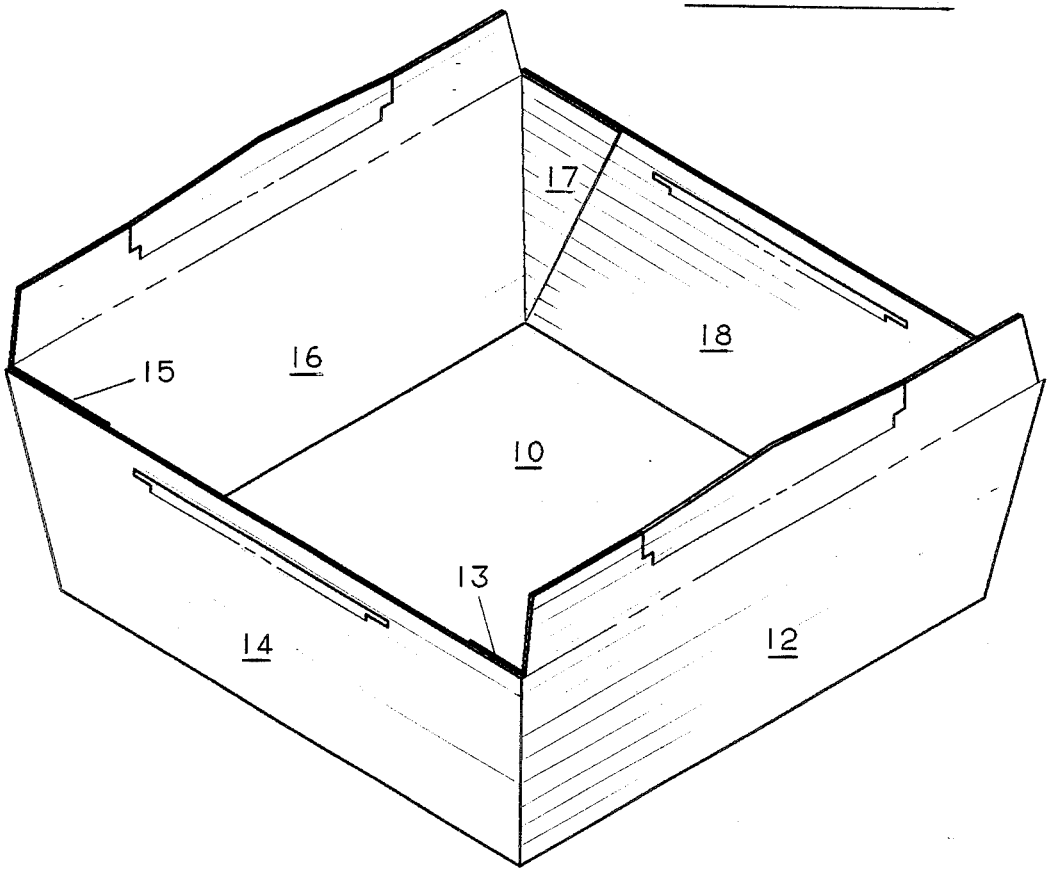

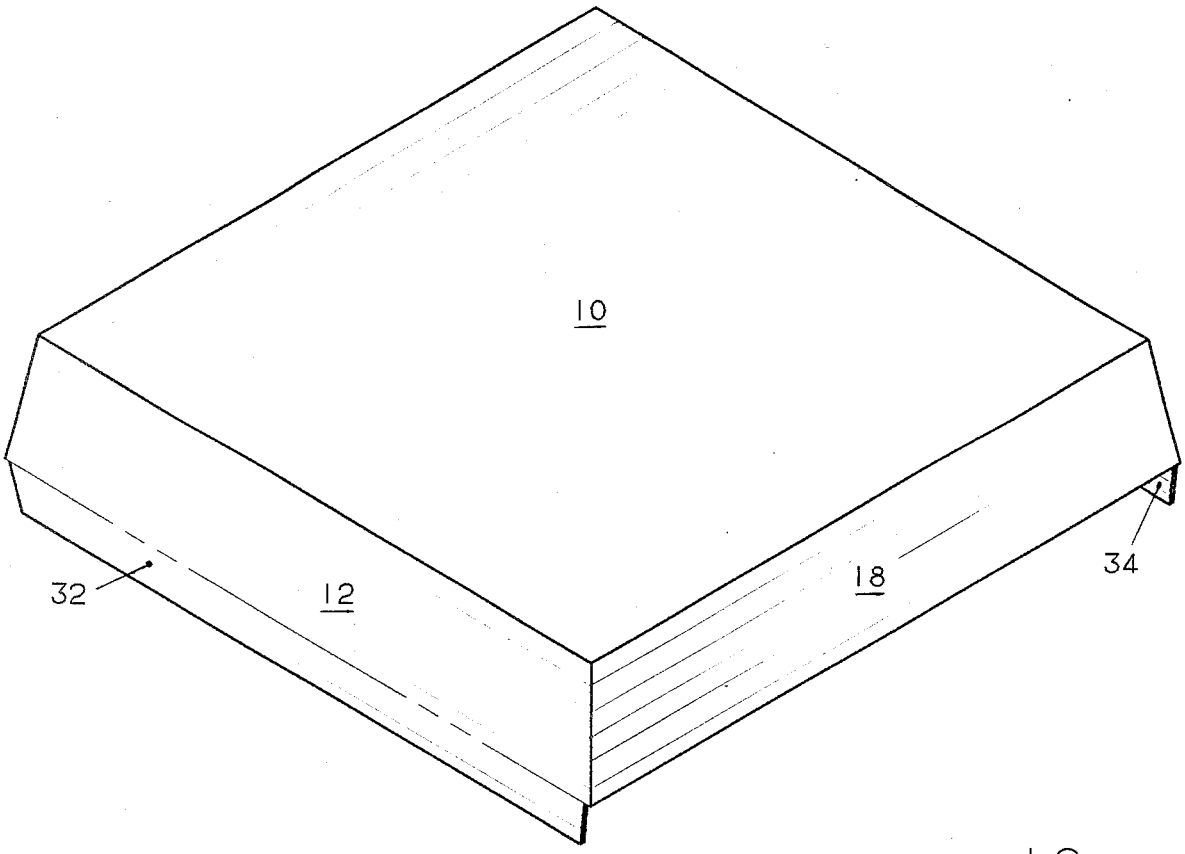
FIGURE 18
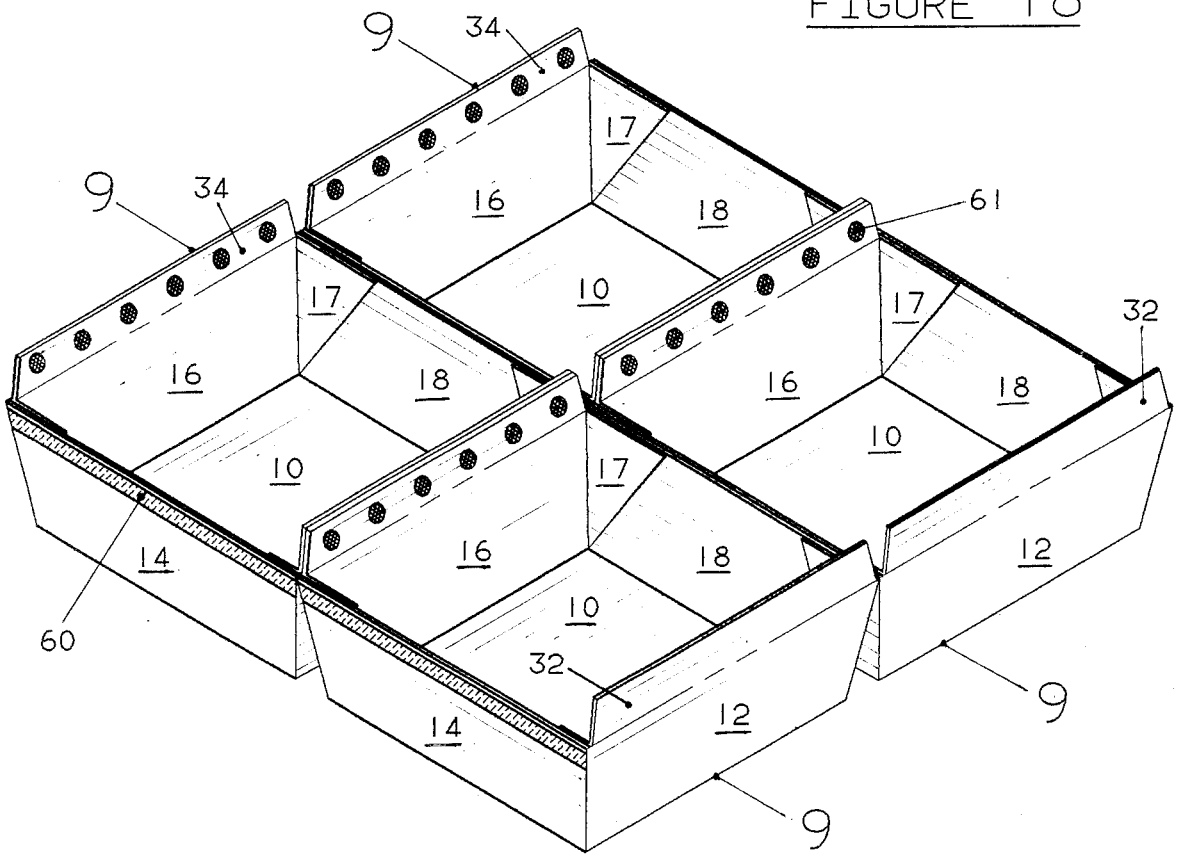

FOOD CONTAINER

BACKGROUND OF THE INVENTION CLASSIFICATION

1. Field of Invention Utilization

The invention disclosed herein pertains to the fast food packaging art.

More particularly, an object of my invention is to satisfy the demand for a low cost, disposable container for packaging foods wherein the container is so constructed of complimentary embodiments that it will protect the food packaged therein for immediate or future use, and additionally during refrigeration, heating and serving of the packaged food. The demand for such a container originates from a number of environment(s) wherein large quantities of foods are prepared and served within a minimum length of time. Readily apparent environment(s) which demand such a food package are fast food chains, airlines, educational, hospital, and government institutions. In either of these environments portions of discreet, premeasured prepared food(s) are cooked for immediate distribution and consumption, or packaged for refrigeration for extended periods of time, quickly reheated and served. Thus a food container used in these environment(s) must be readily open(ed) for quick packing, low in cost, disposable and adapted to protect the food packaged therein under conditions of varying temperatures.

Many attempts have been made to provide a package having said general utility. It may be stated, however that where such packages do exist to satisfy certain of the needs, they have been objectional because of cost, manual forming, the "interfering-other-half", and excessive storage for "pre-assembled" packages. Also objectionable is the use of package(s) formed from "chloro-fluoro-carbon" manufactured plastic foam that destroys the atmospheric ozone layer which protects humans from the sun's cancer-causing ultra-violet rays. Apparent end-users which demanded such a food package are major fast food chains, meat packers, airlines, educational, hospital, and governmental institutions for a means to convey food products to be consumed on site or other environment(s).

A food container used in either of the aforementioned environments must be low in cost, disposable, and adapted to protect the food packaged therein under varying element(s) and temperature conditions; a food container must be of a construction which readily permits the use of high speed, printing, die-cutting, coating, forming and packing machines.

My invention disclosed herein relates to a packaging container which satisfies the diverse requirements discussed, and confronts the objections of existing packaging containers effectively and at lower cost.

Also my inventions unique feature enabling utilization of an embodiment for use as a means to convey food in environments in need of such an application for an additional cost savings heretofore not available. For example in the fast food, pizza, and bakery environments.

2. Prior Art

The prior art reflects an attempt to provide a packaging container which would satisfy all of the diverse criteria established by users of such containers more particularly in the fast food industry. However, to my knowledge, the prior art does not disclose a packaging container which incorporates, in combination, the unique construction which characterizes my invention.

For example, in the fast food industry they employ a food package container constructed from plastic foam material known through-out the industry as a "clam-shell" with a configuration consisting of two halves hinged together to form a single unit, there are also food packages constructed of a high density paperboard having the same configuration as the aforementioned "clam-shell" which also consists of two halves hinged together, both of which are utilized for "in-house" or "carry-out" service. When the "claim-shell" type package is utilized for "in-house" use, consumer(s) usually sit at a table of small size, and prepare to consume the food packaged therein, and confronted with the problem of the "interfering-other-half". Generally, an accepted practice is to tear, or cut-off the "interfering-other-half" and discard it, to acquire more table space. My invention affords the use of a single member of the packaging container for "in-house" use as a tray to convey the food to the table, and a fifty percent cost savings, for the member retained from the packaging container utilized as a lid or cover for "carry-out" service will not be discarded. These same cost savings would be appreciated in the airlines, educational, hospital, and governmental institutions through the utilization of my invention.

Another example, would be the utilization of my invention in the pizza and baking industries. Both industries are confronted with the need of high stacks of "manually preformed boxes" for anticipated "carry-out" to effectively service the consumer(s) in the minimum period of time. Usually this practice is not very efficient for additional boxes must be "manually preformed" due to the inadequate storage space for the boxes and the inability to calculate the amount required.

My invention affords the pizza or baking industries utilization of a normally open major body or tray which has been pre-formed automatically for proper stacking and end-use, that requires minimum storage space.

Also the construction of the container embodiment(s) lends itself ideally to an additional cost savings that can be incurred in manual erection. Through the use of a pressure sensitive cohesive emulsion which adhere(s) to itself and not the substrate of which the embodiment is manufactured.

Prior art patents disclose food packages constructed from various substrates, the preferred being a biodegradeable cardboard of low density for ease of decomposition. Patents also disclose construction of embodiments that employ complex corner joint construction wherein a multiplicity of angularly disposed score lines are used to define the corner joint; multi-sided extension tabs used to define the corner joint; simple angular shaped cut tabs to define the corner joint, all suitable in the construction of an embodiment for my packaging container which the least costly being the angular cut tab. More generally, the fast food industry packaging container is not subjected to wicking consequently the angular tab type blank would utilize less material and an overall cost savings.

Although some patents mentioned the use of various substrate coating(s), the containment intended should be the governing factor to select the proper coating to be applied for an overall cost savings. The open construction of the erected embodiment(s) lends itself to post coating for a particular containment.

There are substrates available with proper coatings for various application(s) which would protect the containment and be utilized in the embodiment construction. For example thermoplastic coated paperboard could have the corner tabs heat sealed or ultra-sonically bonded to the side walls. The use of metal foils as a material is disadvantagous in that it is not ideally suited for use in a microwave oven.

Packaging containers which are exclusively made of plastic as the material are not as attractive for the prohibitive costs of manufacture verses high speed, high volume, manufacturing methods would defeat the purpose of a low cost packaging container.

Another problem indigenous to many prior art container(s) relates to lid, or cover, placement, while consuming the containment, which lends itself to being unattractive, and interfering, and the difficulty of removing the lid or cover from the major body. Typically this problem is most severe in the case of permanently bonded containers. When such construction(s) between the major body member and the lid, or cover, is so strong as to necessitate the use of a cutting device, e.g. a knife, to open the container. Mechanical devices are incorporated that pre-weaken the bond, e.g. tear edge perforations, to enable one to remove the lid, or cover, of the container.

Finally, it can be pointed out, a typical environment in which premeasured prepared food packaging container(s) are employed require(s) that the container(s) be attractive, purposeful, utilizing minimum materials for construction, and low cost manufacture. Containers so constructed and arranged as to permit heating, reheating, and cold storage of the containment(s). In this connection, the prior art has recognized these encounterment(s) can generate undesirable gaseous conditions which cause excessive internal pressure(s) that in turn can deform, or destroy, the container without protective measures. Prior art has resorted to a number of construction expedients, almost all of which may be characterized by the fact that they increase either, or both, the material, or manufacturing, cost(s) of the packaging container.

Also prior art, in the construction requirement, to satisfy containment requirements in environment(s) more particularly in the fast food industries, the need of which must be hastily erected, or fabricated, packaging containers, the material(s) utilization ratio of product containment to container capacity is excessive. An example of which is the packaging container familiar to over-the-counter usage in bakeries, pizza establishment(s) and various fast food environment(s).

In summary, the prior art discloses a number of container(s) which satisfy one or a few of the criteria established by users of food packaging containers. However, the prior art does not disclose a container which satisfies all of the criteria previously discussed.

3. Alternative Embodiment(s)

It be understood that, while the food packaging container discussed herein is adaptable for other purposes and also it be understood that various modifications may be made in the form and arrangement(s), other than have been previously herein discussed, of the elements illustrated in the drawings without departing from the spirit of the invention. Some alternatives will hereafter be discussed:

I. In initial use the package container major body may be packed with one, or more, containment(s) as an example, the lid, or cover, applied, and an overwrap, shrunk or sealed, encasing and forming a more rigid container, although inexpensive, composite packaging of selected containment(s) is provided which package is also hermetically sealed, containment(s) then can be frozen, transported in a frozen condition and subjected to heat at the point of consumption. Dehydration is prevented because of the hermetical sealing by the overwrap. More importantly the overwrap provide tamper evident protection prior to consumption. It will be understood that the overwrap may be printed with legends and/or pictorial matter indicating the containment and the source thereof in addition to the container printing previously applied. When the containment(s) is to be consumed or utilized the overwrap can be torn away and the lid, or cover, removed.

II. In initial use the package container(s) major body is open at the top to be packed, and is nested one into one other, that have been previously erected automatically. In the present day pizza environment(s) excessive set-up time is spent erecting box(es), installing inserts, etc. An alternative object of my invention is to provide a new and mproved pizza packaging box(es), more particularly, an object is to provide box(es) which will enable grease or other liquids to drip or wick off pizza(s) but not to penetrate through the substrate which help enable delivery of pizza(s) in a crisp, optimal state, without creating a greasy condition which may stain clothes, car seats, or the like. Also my invention discussed herein features pre-assembled pizza box(es) which were set-up automatically while previously discussed embodiment(s) features provide manual easy-to-assemble box(es) with a minimum of effort, requiring no inserts. To enable good air circulation and heat retention, factors relating to pizza containment, a major body embodiment(s) of my invention be made from a unitary, double-sided corrugated cardboard blank having a plurality of scored and cut lines to enable a quick and easy manual box(es) erection or quite suitably incorporated into a high speed, printing, die-cut, folding, erecting, and packing machinery operation. The use of a moisture resistant coating which can be applied quite readily in the original mode of operation, or as a post-operation because of the previously erected embodiment(s) open top—a feature of my invention that lends itself easily to this type of operation. The bonding method heretofore discussed herein would also be applicable although the substrate be corrugated and of smooth sides or surface(s) which would additionally provide automatic venting for excessive internal pressure(s) and gases relative to a pizza containment.

III. In initial use the package container(s) major body is open at the top to be packed, and is nested one to one other, that have been automatically erected. In the present day bakery environment(s) valuable time is spent erecting box(es), filling the box(es) with various pastries, then tie or apply tape for cover retention.

My invention features the open top for ready packing with the cohesive type bonding to readily apply a lid or cover. In addition the in-line method FIG. 7, 8, 9 of manufacture that would be incorporated for low cost unit(s) has the ability for a major body embodiment(s) blank which is to be a lid, or cover, can have a window FIG. 10 die-cut into the base portion and a clear glassene 20 or other clear substrate adhered to the blank to cover the die-cut opening as a "look-see" feature of the containment.

In summary, my invention is ideally applicable to the fast food environment(s) as in other environment(s)

with added modification(s) or feature(s) as has been discussed in the aforementioned adaptation alternative(s) which at this writing are too numerous to mention. The intent herein discussed is to provide a packaging container which can be utilized efficiently and effectively at low cost to the consumer, and the greatest savings can be acquired in environment(s) that package containment for on site and/or carry-out for the unique feature of my invention—the optional major body or tray to be applied as a lid, or utilization of a hinged two compartment(s) packaging container.

SUMMARY OF INVENTION

The food packaging container of the invention disclosed herein includes a major body and a like constructed member lid, or cover, of a substrate, preferable paperboard, having a coating on at least the interior surface(s) thereof to aid in retaining the containment. The packaging container consists of a major body or tray embodiment and a mating lid or cover embodiment both of which include a base portion and a plurality of upstanding walls. Preferably, the embodiment(s) should be square with four divergingly upstanding walls which are foldably connected to the base portion. The upstanding walls are transversely interconnected by corner closures. Each corner closure is foldably connected to one or both of the upstanding wall(s) or at one end thereof and is overlapping attached to the transverse end of the adjacent upstanding wall(s). Additionally, the fold line and separation line which initially define the corner closure(s) are arranged such that when a major body, tray, or cover are formed, a land is provided at the lower corner of each major body, tray, or cover.

Of the four upstanding walls two of the upstanding walls is foldably connected to an extended panel(s) on the same diverginal plane. The extended panels are to be abutting so as to form a peripheral flap or flange that is to be when bonded to a mating member upstanding wall to form a food package container. Each member of the embodiment(s) are constructed of the same two upstanding walls with foldably connected extended panel(s) on the same diverginal plane to bind one member embodiment to one other to construct a food packaging container.

The major body extended panel flange is bonded to the major body utilized as a lid or cover, upstanding walls without the extended panel(s) of the mating member of the embodiment. While the mating member upstanding wall extended panel(s) is bonded to the major body upstanding walls without the extended panel(s) to form the food container.

The bond between the upstanding wall(s) extended panel(s) and the upstanding wall(s) without the extended panel(s) is heat or pressure sensitive, i.e. the bond material and the aggregate bonding area are selected and adjusted such that the bond between the upstanding wall(s) and the upstanding wall(s) extended panel(s) will be positive and allow use of a cohesive emulsion or coating that be sensitive to itself rather than the substrate to which it has been applied. Example of which is currently being used in the art of self-sticking envelopes, and other emulsions applied to substrate which allows(s) for multiple opening or closing of envelopes.

Preferably, both the major body member(s) and the lid or cover member(s) of the container embodiment should have the cohesive type emulsion applied to a substrate which has been properly coated for the containment intended for use in the fast food environment(s) as the bonding of the upstanding wall extended panel(s) and the mating upstanding wall(s) require the least amount of heat or pressure to produce the required bond to form the food packaging container embodiment.

Also the bond material(s) selected and adjusted such that the bond between the members of the embodiment will fail at pre-selected temperature(s) and/or because of increased pressure within the container should the embodiment be subjected to extreme temperature(s) or pressure(s) that would develop when the food container(s) be placed in a conventional or microwave oven for reheating, or other adverse environment(s).

Bonding material(s) are generally pressure or heat sensitive, in the form of an emulsion, hot melt, or tape, of the dry or liquid type activated by heat, pressure or moisture, and can be applied to the substrate utilized to construct the embodiment in the form of a coating used to retain or to protect the containment therein for which the food packaging container is intended.

An alternative application which embodies my invention is the use of a tear edge to release or remove the top, lid, or cover member from the major body member where positive heat seal, or mechanical, bonding is used to construct the food packaging container as a means to prevent destruction of the container embodiment(s) prior to full utilization of the containment.

Another alternative is the application of a shrink wrap type sleeve which can be utilized to insure retention of one member to one other as a means to discourage tamper, protect the container from the elements, or to allow the total container and containment to be immersed in a fluid or other intended environment(s) to heat, or chill, the food product therein.

The unique feature of my invention is the ability to utilize the major body member as a tray, or utensil to contain food, as for "in-house" use in the fast food industry and quite readily utilize a like member which is inverted, turned 90 degrees FIG. 2 in relationship to the mating member, to serve as a lid or cover for "carry-out" service. This same feature would be beneficial to the pizza and baking industries.

As a pizza, or baking, container one need simply reverse the sequence of constructing a food packaging container, nest the major body member with the containment into the inverted lid, or cover and thus resolve the objectional protruding "interfering-other-half" while the containment is consumed.

As implied previously the use of a cohesive emulsion which has been properly selected and adjusted multiple opening(s) and closing(s) of the food packaging container would be possible to protect the containment until totally consumed.

DESCRIPTION OF THE DRAWINGS(S)

FIG. 2 is a view, in perspective, of a major body, or tray, of FIG. 1, and an inverted then turned 90 degrees major body, or tray, of FIG. 1 prior to forming an embodiment of my invention.

FIG. 10 is a view, in perspective, of a major body or tray of FIG. 1, and a lid or cover of the same embodiment with window prior to construction of FIG. 11.

FIG. 12 is a view, in perspective, of a major body or tray with tabs & slots of the configuration of FIG. 1 and one other prior to construction of FIG. 13.

Figure 3:
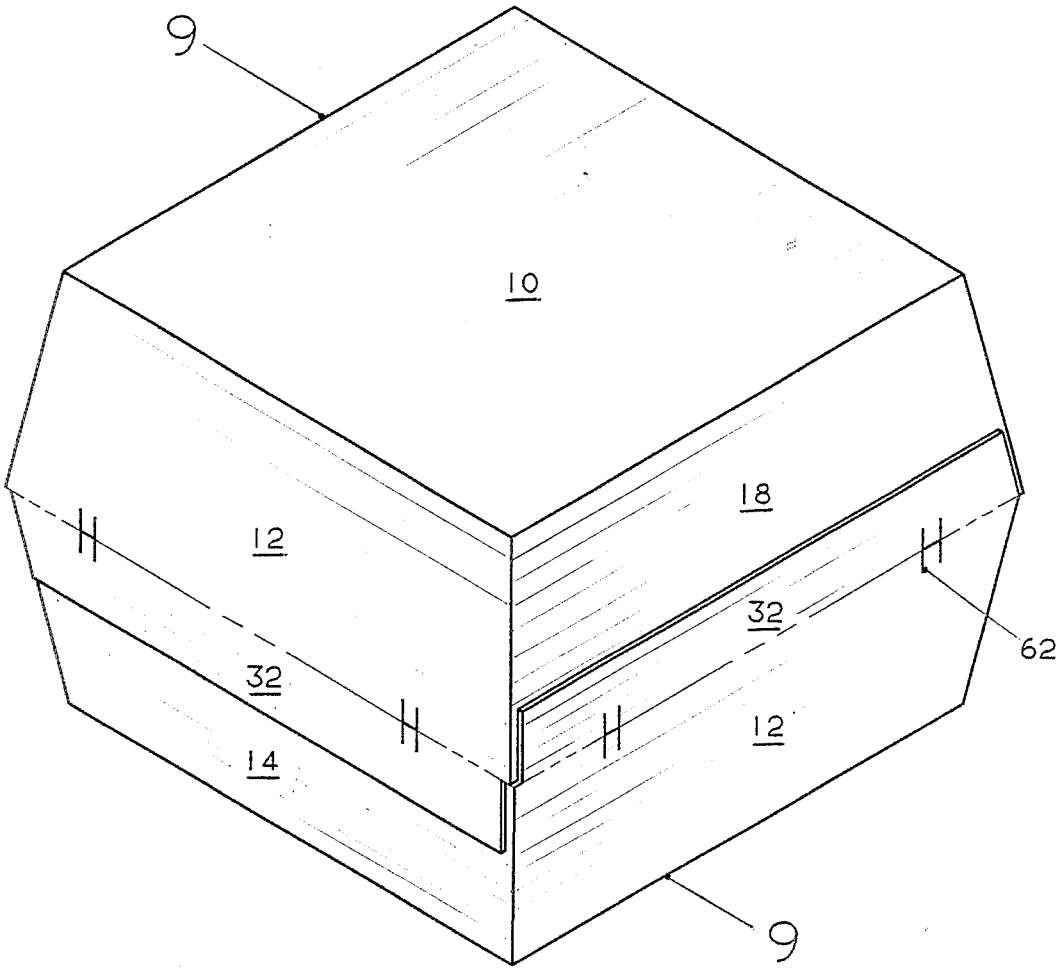
FIG. 3 is a view, in perspective, of a major body, or tray, which in combination as shown in FIG. 2, and bonded to construct an embodiment of my invention.
Figure 14:
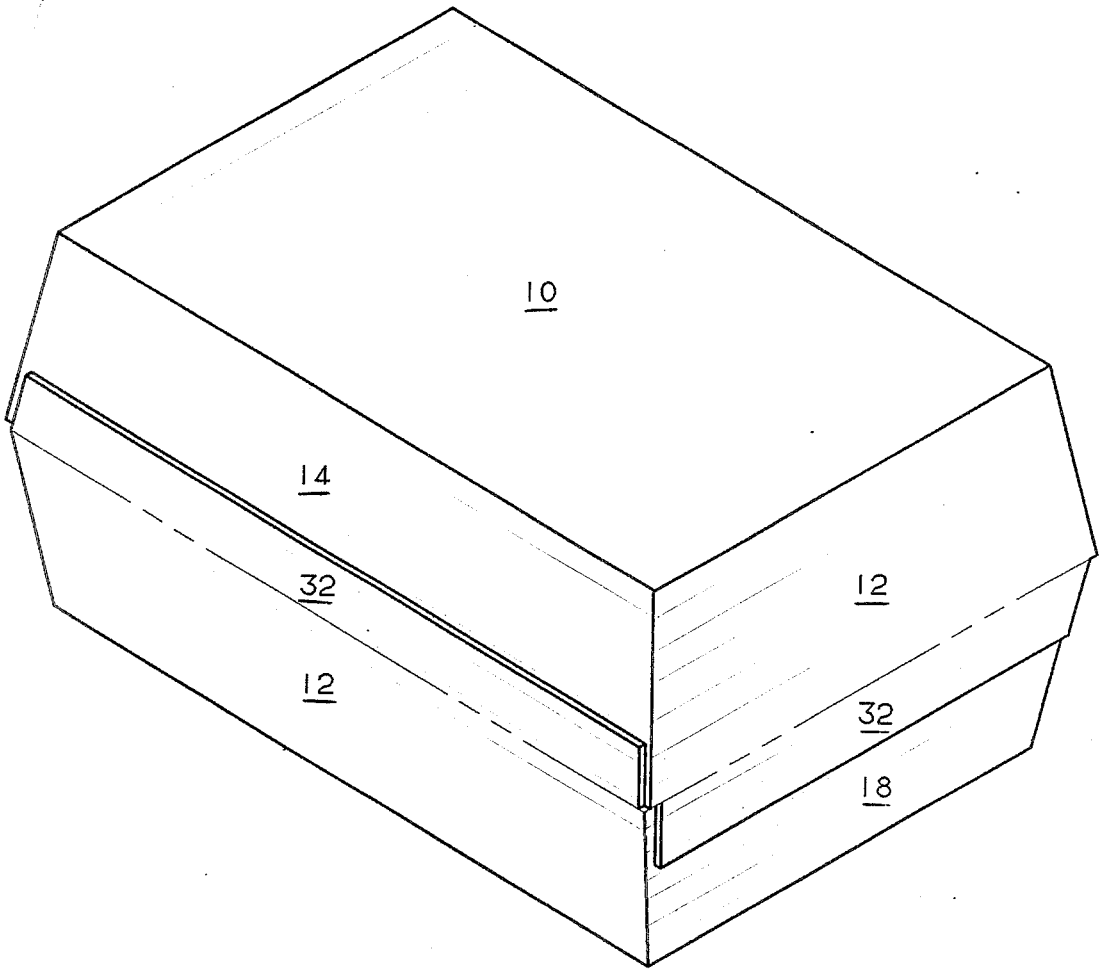

FIG. 14 a view, in perspective, of a rectangular embodiment constructed in like manner as FIG. 3.

Figure 15:
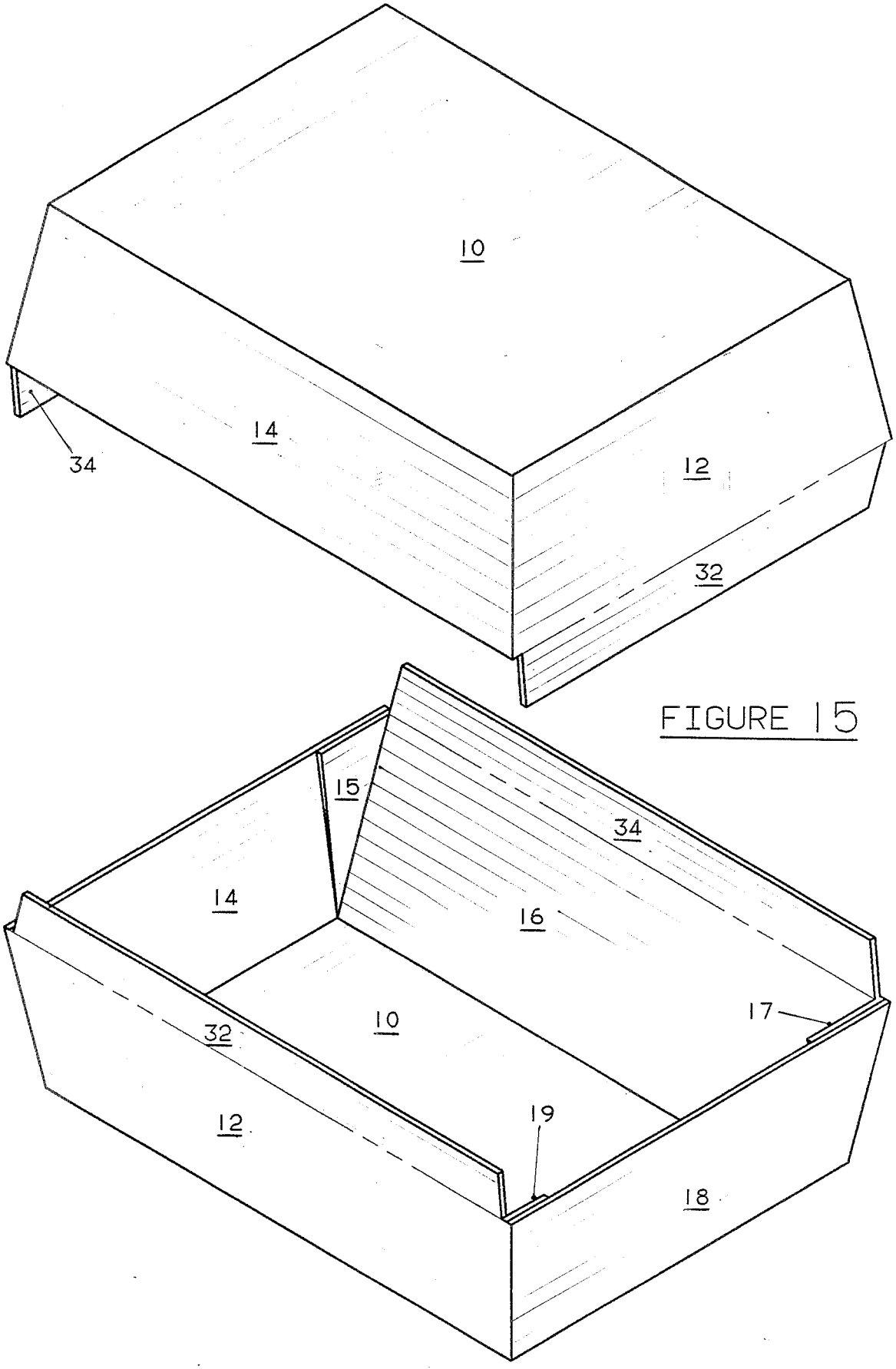

FIG. 15 a view, in perspective, of a rectangular embodiment prior to construction as in FIG. 14.

Figure 16:
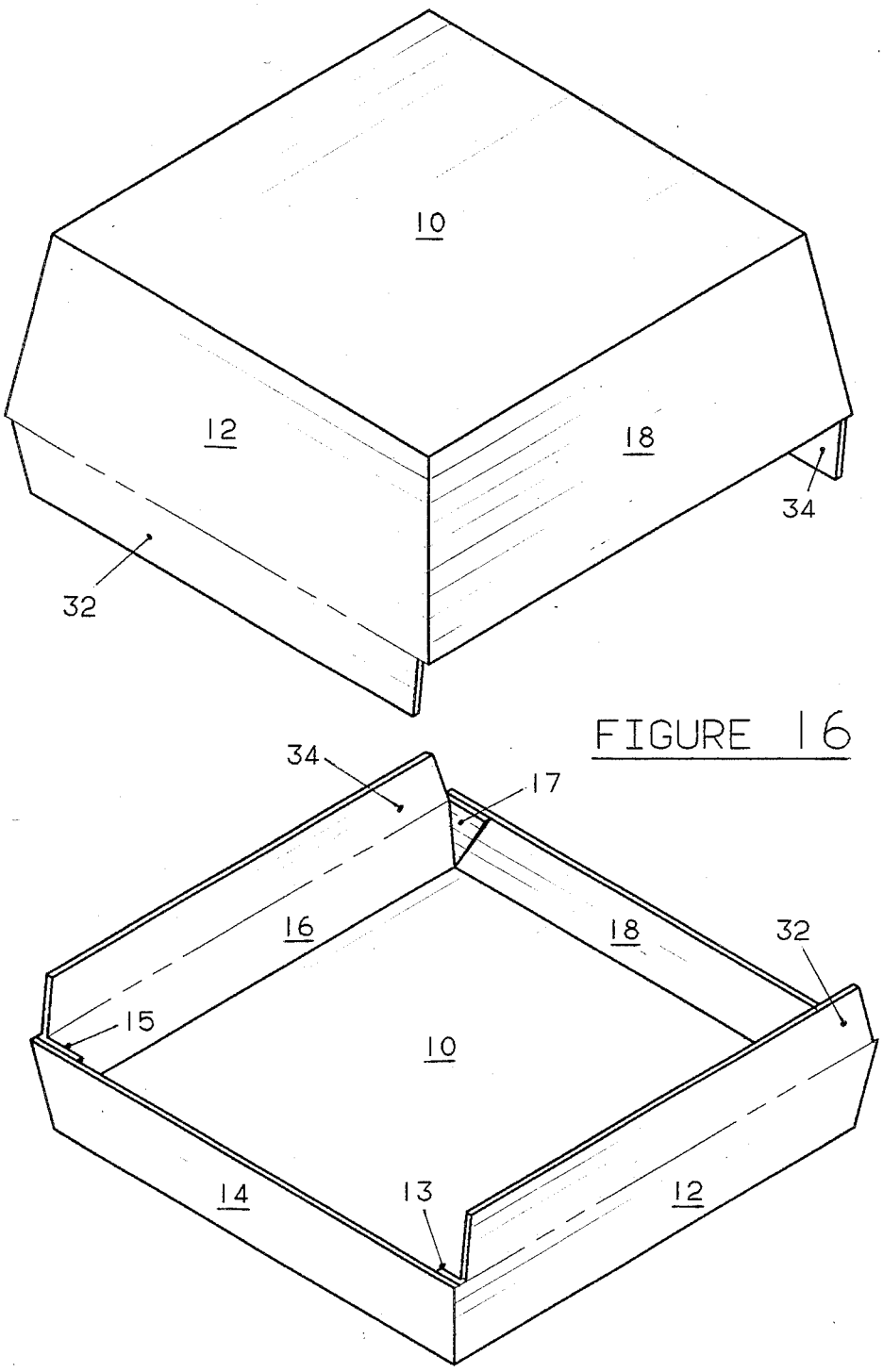

FIG. 16 a view, in perspective, of a dissimilar embodiment(s) to construct an embodiment in kind as FIG. 3.

Figure 1:
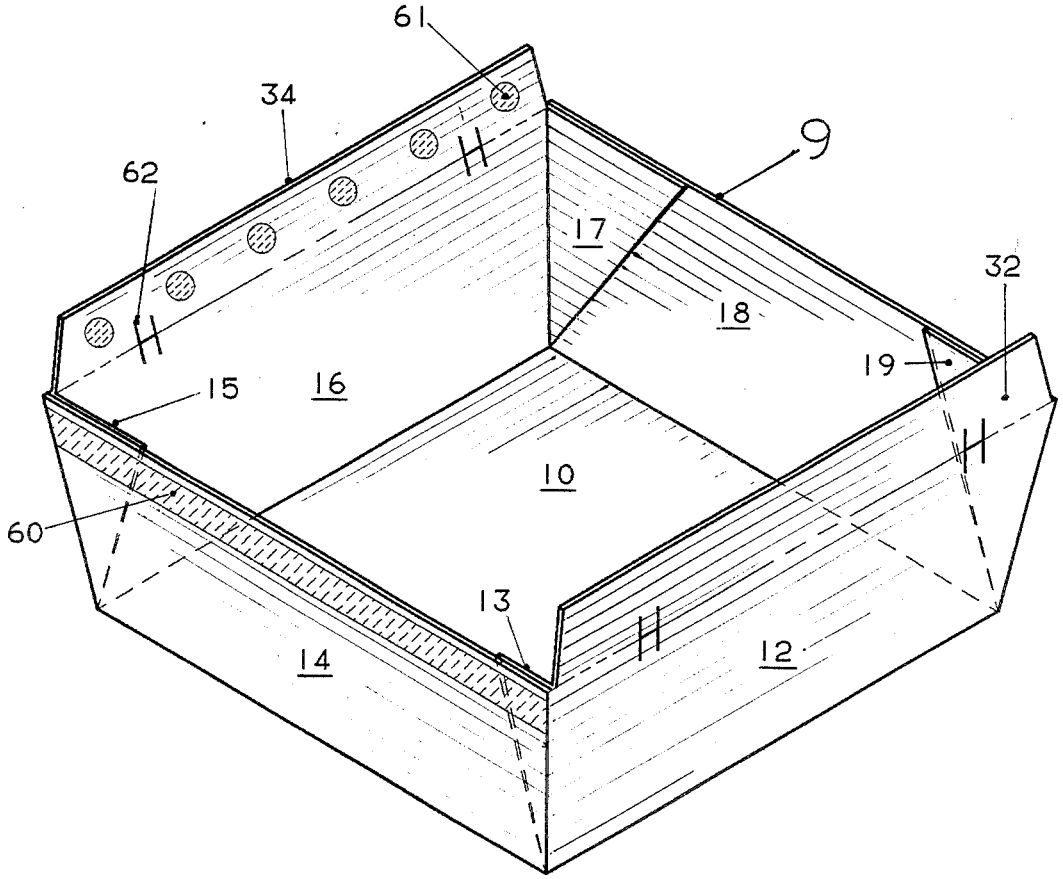
FIG. 1 is a view, in perspective, of a major body, or tray, fully erected, which embodies my invention.
Figure 17:
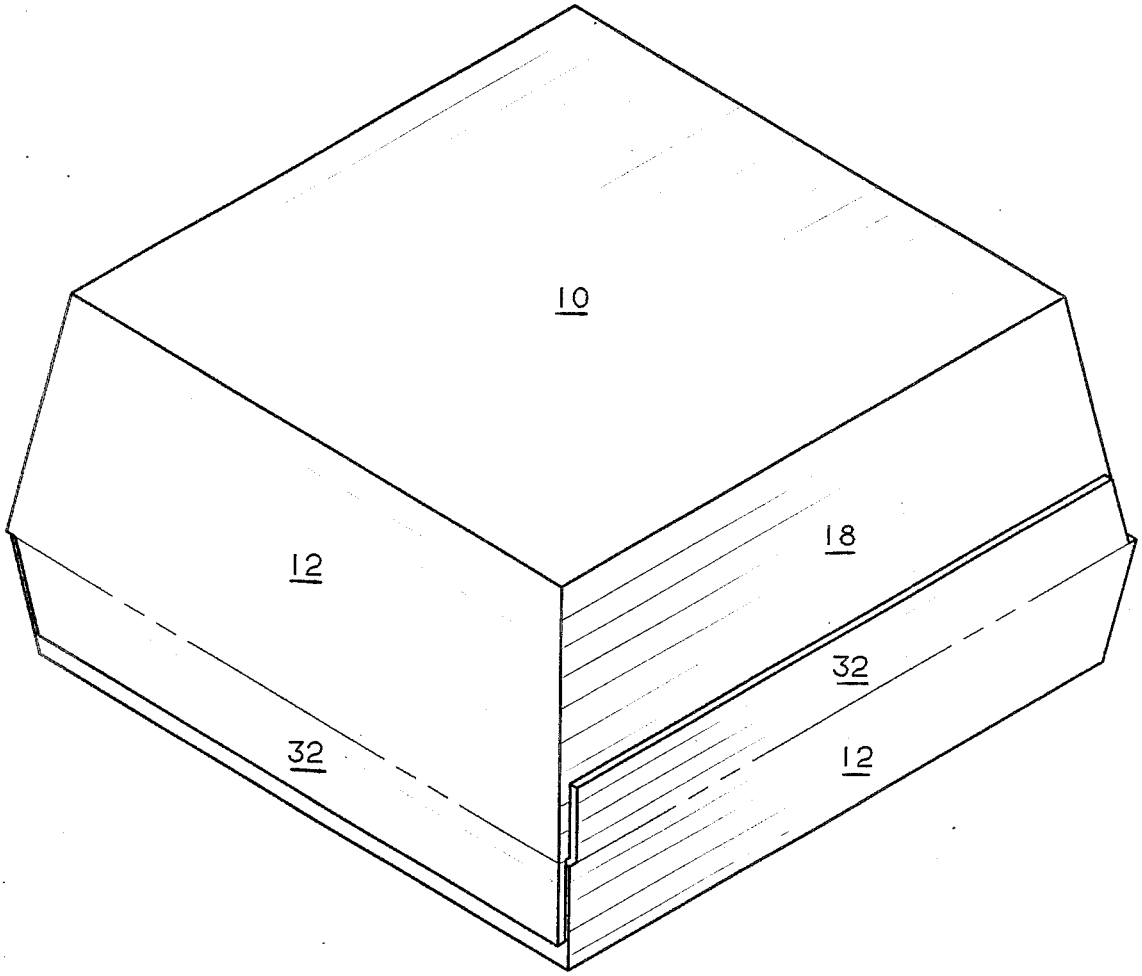

FIG. 17 a view, in perspective, of an oversized major body, or tray, constructed in like manner as in FIG. 1.

FIG. 18 a view, in perspective, of multiple embodiments of FIG. 1 to construct a compartmented major body, or tray.

Figure 19:
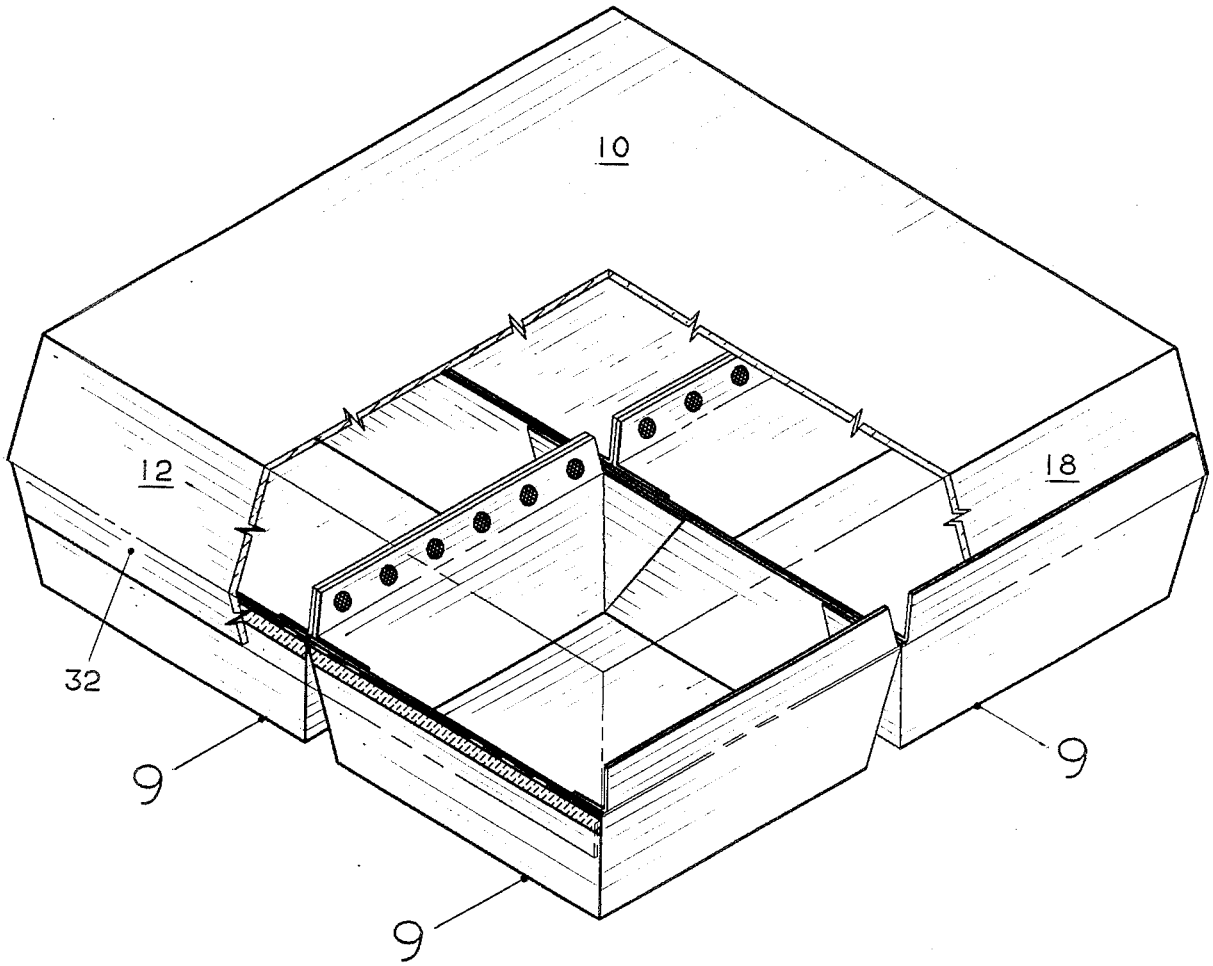

FIG. 19 a view, in perspective, of the lid or cover of FIG. 17 in combination with the compartmented major body, or tray, of FIG. 18 to form a compartmented package.

DESCRIPTION OF THE PREFERRED EMBODIMENT(S)

A preferred embodiment of my invention is shown in FIG. 1 and includes a major body or tray 9 having a rectangular or square base portion 10. Upstanding walls 12, 14, 16 and 18 are foldably connected to the base portion 10 at fold lines 22, 24, 26 and 28 respectively, the aforementioned fold lines being more clearly seen in FIG. 4. Preferably, the upstanding walls are divergently disposed, as shown in FIG. 1, rather than vertically disposed. Divergently disposed walls are preferable because the rays may then be nested prior to being filled and lidded. A desirable angle of divergence is approximately 15 degrees away from the vertical.

Figure 4:
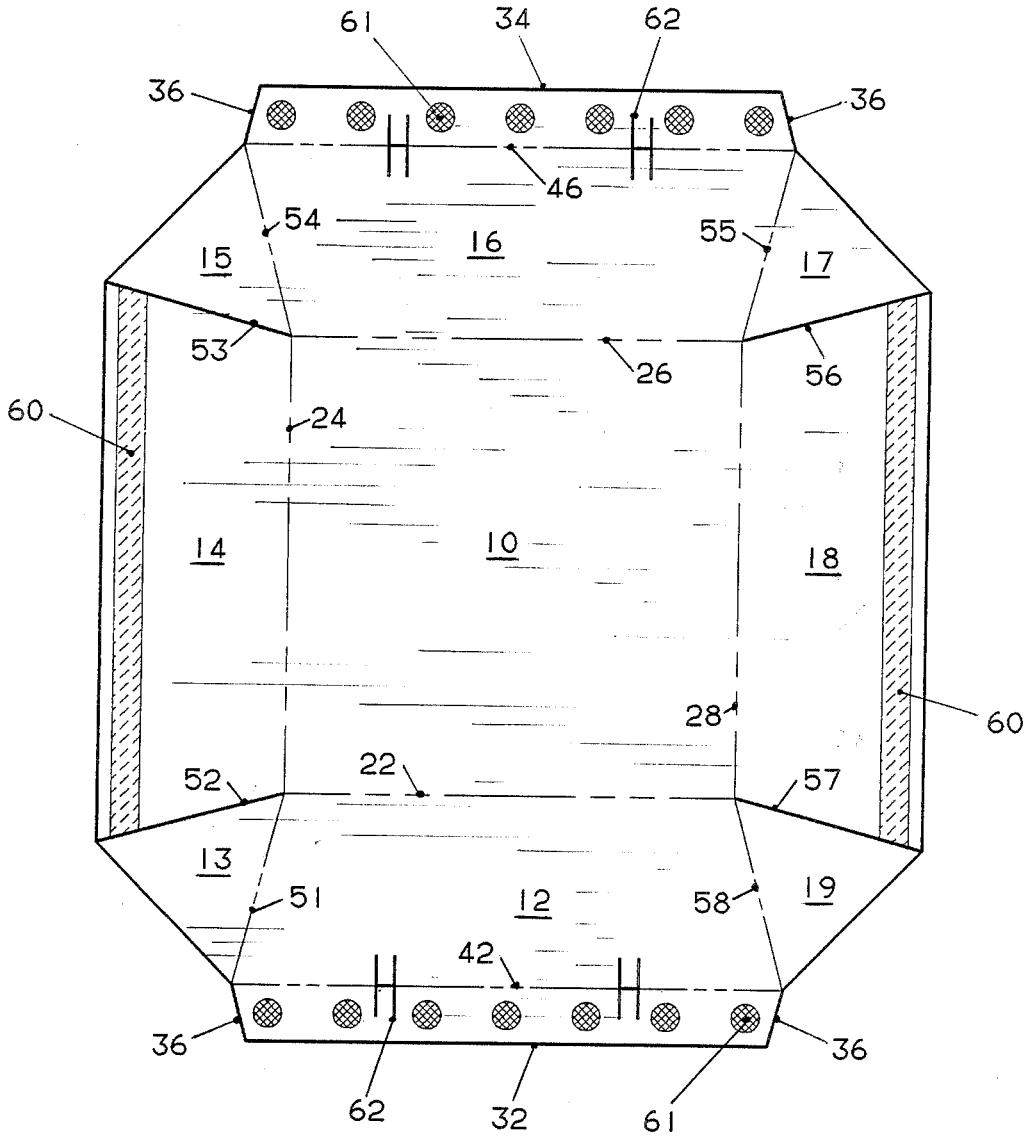
FIG. 4 is a plan view of a blank having a plurality of scored and cut line(s) which may be erected to form a major body, or tray, of the type shown in FIG. 1.
Figure 5:
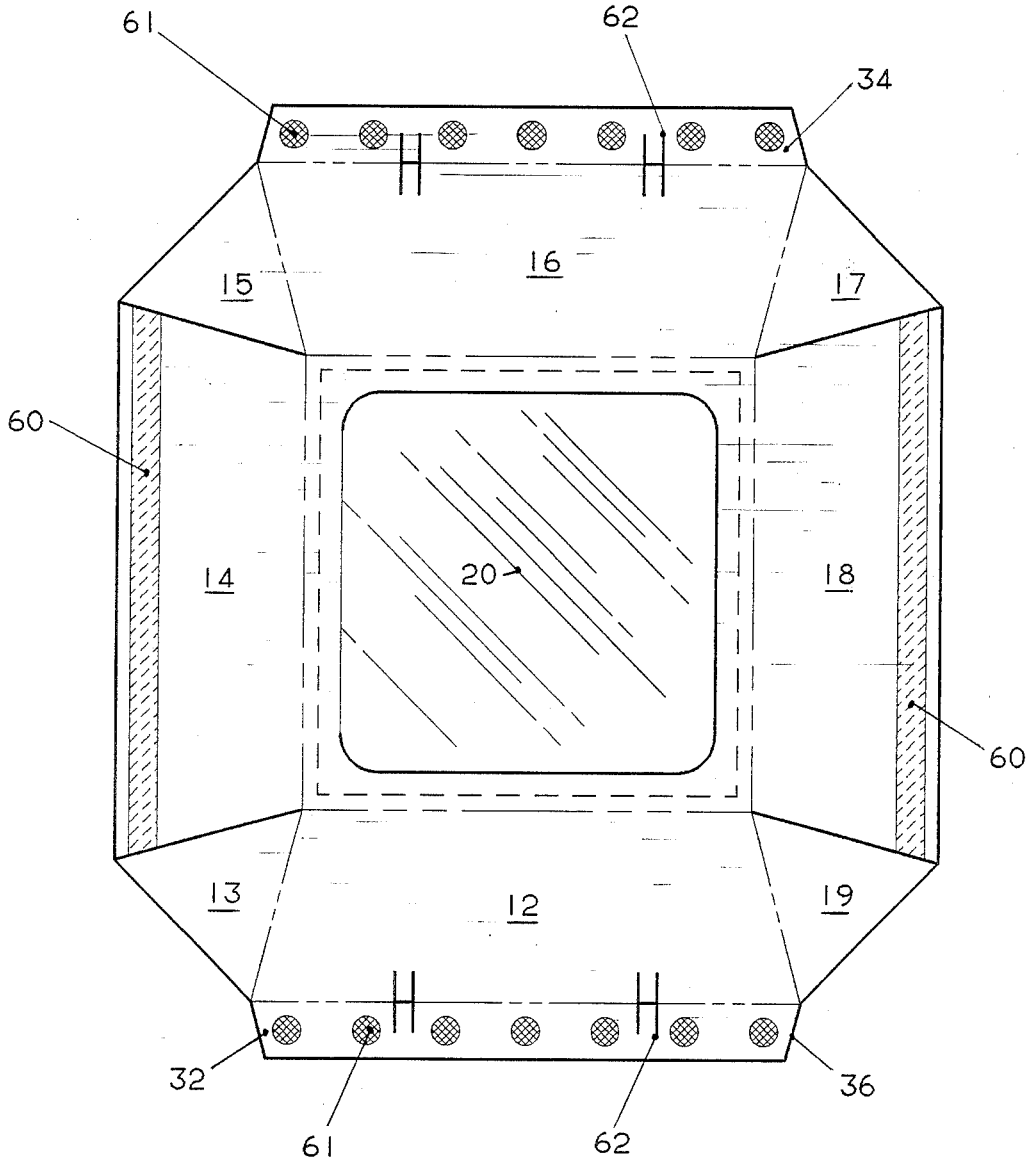
FIG. 5 is a plan view of a blank having a plurality of scored and cut line(s), and a die-cut opening with a protective clear substrate applied as a window, which may be erected to form a major body, or tray, of the type shown in FIG. 1 then utilized as a lid, or cover.

Referring to FIG. 4, it will be seen that panels 32 and 34 are foldably connected to upstanding walls 12 and 16 by fold lines 42 and 44, respectively. When the blank of FIG. 4 is erected to form a tray as shown in FIG. 1, it will be noted that the panels 32 and 34 are divergingly disposed. Moreover, it will be noted that the ends of the aforementioned panels are transversely cut such that when the blank is erected to form a tray as shown in FIG. 1, the extended diverging panels are angularly cut, 36, for transversely abutting mating member corners for improved cosmetics.

Referring again to FIG. 4, it may be noted that corner closures 13, 15, 17 and 19 are provided between the ends of adjacent wall panels. Moreover, it will be noted that each of the corner closures 13, 15, 17 and 19 is foldably connected, along a transverse fold line, to one of the wall panels and is separated from the adjacent wall panel by a cut or severed line. For example, corner closure 13 is foldably connected to wall panel 12 by fold line 51 and is separated from wall panel 14 by the cut 52. Similarly, fold lines 54, 55 and 58 foldably connect closures 15, 17 and 19 to wall panels 16 and 12, respectively. Cut lines 53, 56 and 57 are analogous to cut line 52.

Referring particularly to the fold line(s) and to the severed line(s) which define each of the corner closure(s), it may be observed that in all cases the fold lines originate at an intersection of two other fold lines whereas the associated cut or severed line originates at a point slightly distant from the intersection of the aforementioned fold lines. For example, referring to corner closure 13, it may be noted that fold line 51 originates at the intersection of fold lines 22, 24 and extends outwardly to fold line 42. However, it will be noted that the severed line 52 originates at a point slightly distant from the intersection of the fold lines 22 and 24. The significance of originating the severed line at a point distant from the intersection of the interior fold lines resides in the fact that by using such a construction a land will automatically be provided when the blank is erected to form a container. Thus, considering corner closure 13 as an example, if the severed line 52 were to originate at the intersection of the fold lines 22 and 24, when the blank was erected to form a tray, there would be an opening or discontinuity at the lower part of the tray, viz at the point where the severed line 52 contacted the intersection of the fold lines 22 and 24. Thus, by originating the severed line 52 at a point distant from the intersection of the score lines 22 and 24, the corner closures and the upstanding walls adjacent thereto define a land at the bottom of each corner of the tray and thus an opening or discontinuity is avoided at the bottom of each corner of the tray.

Referring particularly to the fold line(s) 51, 54, 55, 58 and the severed line(s) 52, 53, 56, 57 which define each of the corner closure(s) and with readily plyable substrate(s) the severed line(s), 52, 53, 56, 57 would become a fold line(s) with an additional fold line(s) bisecting the fold line(s) which define(s) each of the corner closure(s). Thus the corner closure(s), the upstanding wall(s) adjacent thereto and the bottom land of the tray would form a continuity. This continuity would displace the folded corner closure(s) inwardly, or outwardly, for cosmetic appeal.

In accordance with my invention, the blank shown in FIG. 4 are constructed of paperboard. Further, the blank shown in FIG. 4 which can be coated on the surface which will be located interiorly of the container, with a containment protection coating. Preferably, both the surfaces of the blank is coated with a thermoplastic. Experiments conducted upon the occasion of this invention indicate that thermoplastic is generally a preferable coating and, when a thermoplastic is employed, the preferable coating thickness is minimal for an overall cost savings.

By thermoplastic coating at least the interior of the blank of FIG. 4 a number of benefits are provided. For example, the resulting container is substantially water proof. Additionally, and even more important benefit resides in the fact that the surfaces of the resulting container construction are relevantly gas impermeable. While the full significance of providing such a construction will be pointed out hereinafter, suffice it to say, at this point, that by providing impermeable surfaces, a functionally superior food packaging container may be obtained.

Preferably, the basis weight of the paperboard is a determinent of the containment intended.

With respect to erecting the blank of FIG. 4 so as to form a tray such as shown in FIG. 1, such erection and assembly may be easily accomplished through the use of high speed forming and packaging machines. In this connection, it is noteworthy to observe that the construction of the blank shown in FIG. 4 is particularly amenale to high speed forming. For example, because each of the corner closures is foldably connected to only one of the adjacent end wall panels, the erection time and forming speed may be significantly reduced. Indeed, the construction of the blank shown in FIG. 4 is particularly significant in the regard because the end closures are foldably connected to opposed wall panels. Thus, it may be noted that end closures 15 and 17 are foldably connected to the wall panel 16 while end closures 13 and 19 are foldably connected to the wall panel 12. As such, when the blank of FIG. 4 is formed into a container a tray, the walls 14 and 18 may be folded into an upstanding position without a restraint being imposed thereon through a connection to the wall panels 12 and 16 or any of the corner closures 13, 15, 17 and 19. Either after or simultaneous with the folding of the end panels 14 and 18, into their upstanding position, the opposed walls 12 and 16 may be folded and, thereafter, the end closures 13, 15, 17 and 19 positioned interiorly of the walls 14 and 18. Thus, it will be appreciated that the construction shown in FIG. 1 facilitates the forming of a embodiment as opposed to many prior art constructions wherein elements corresponding to the corner closures were foldably connected to all of the upstanding walls, although with slightly more cost(s) the containment intended might absorb this cost in lieu of hte preferred severed type corner closure(s). Moreover, since each of the corner closures is attached to only one, or both, of the adjacent walls, there is no criticality associated with the sequence in which the walls are folded, e.g. they may be folded simultaneously.

With further regard to the formation of an embodiment as shown in FIG. 1, it may be noted that the corner closures are positioned interiorly of the upstanding walls. More particularly, the end closures are overlappingly bonded-to the upstanding walls which is adjacent to the upstanding wall to which each end closure is foldably attached. Although a number of methods could be utilized to adhere or bond the corner closures to the upstanding walls, a preferred construction results from coating both the interior and the exterior of the tray with a thermoplastic, e.g. polyethylene. In this manner, the corner closures may be overlappingly bonded to the upstanding walls by heat sealing the corner closures to the walls, i.e. by using the exterior and interior thermoplastic coating to achieve a bond. In the event that only the interior of the tray is coated with a thermoplastic, a bonding emulsion, or cohesive, may be used to bond the corner closure to the walls.

Considering the embodiment shown in FIG. 1 a continuous band of bonding cohesive is applied to the exterior of the upstanding walls 14, 18 while an intermittent pattern of bonding cohesive is applied to interior of the divergingly extended wall panels 32, 34. The function of the cohesive is to form a permanent or temporary bond of the major body embodiment and a like mating lid, cover, or tray embodiment to form a food packaging container which comprise(s) my invention. Although the continuous or intermittent pattern may be applied to either the aforementioned embodiment member(s) certain aspects regarding the cohesive may be varied. Thus the bonding area and the cohesive employed must conform to the criteria now to be set forth, which is to be applicable regarding all methods of bonding one to one other to construct a food packaging container.

In order to appreciate the significance of the bonding connection(s) between the major body and an inverted then turned 90 degrees major body utilized as a lid or cover, it must be recognized that an important object of my invention is to provide a food packaging container which will protect the containment therein during periods of transit and exposure to varying temperatures, as an example heating and refrigeration, while nevertheless providing a container which can be utilized during containment consumption. Although not readily apparent, objective(s) of container utilization are, in fact, conflicting. Thus if food is to be adequately protected from conditions of refrigeration, it is imperative that the packaging container provide an effecitve seal to prevent the food packaged therein to become dried, and by the same token during heating, or reheating, of the food packaged therein, it is imperative that the packaging container provide an effective vent to elevate the internal pressure(s) and gases generated to prevent packaging container distortion or destruction. Prior art recognized these problem(s), the typical approach taught by the prior art contemplate(s) the use of, for example, a thermoplastic shrink sleeve, or wrap, to protect the containment from drying during periods of refrigeration. Here again the containment need be the determinent of the added expense. Thus in container usages relating to fast foods the additional costs savings could be offset through necessity. In the utilization of container for containment heating, or reheating, prior art has advocated venting through the use of melt plugs, die-cut vent holes, and/or manual puncture, to relieve generated internal pressure(s) or gases. Although it is true that the aforementioned measures provide an effective protection from literally exploding or at a minimum, grossly deform, or destroy, the container. The additional cost(s) of these measures are generally offset again by the necessity regarding the containment.

In contradistinction to the prior art, a packaging container constructed in accordance with my invention avoids such difficulties by employing a cohesive emulsion, selected and adjusted, connection between the major body embodiment and one other major body embodiment which has been invertd and turned 90 degrees, FIG. 2 utilized as a lid or cover. A heat sensitive, pressure sensitive, or moisture activated emulsion(s) may be applied to the substrate in designated area(s), in like manner as herein to be discussed in an application(s) of a cohesive emulsion(s) for bonding major body embodiment(s) one to one other to incorporate an automatic venting method, which can be low in cost and effective.

Carefully considering the automatic venting which is obtained in accordance with my invention, it will be appreciated that in order to achieve such automatic venting a bonding material must be selected which has a bonding strength within a particular range, and an easily adjusted pattern application. In other words, in order to achieve a bonding connection(s) between the prescribed container members, the bonding material and pattern are selected such that at the pre-selected temperature, the aggregate strength of the bonding connection(s) will be equal to the outwardly directed force exerted on the lid, or cover, due to increased internal pressure or gases. Thus the particular bonding pattern employed will vary with both the size of the container and the bonding material which is selected.

However, it will be further appreciated that in order to obtain a container in accordance with my invention, still other constraint(s) relating to the bonding pattern must be satisfied. For example, although the width of the bonding connection may be varied, it is critical that the bonding connection is a continuous pattern 60 on one major body embodiment member, and an intermittent type pattern 61 on one other major body embodiment member which are to be the container(s) mating member(s). Thus, it may be noted that the bonding pattern is a continuous pattern 60 located around the periphery where the major body member(s) are enjoined for container utilization not requiring venting which will insure adequate protection to containment. For example, against freezer burn.

When packaging certain foods which will require heating, or reheating, a bonding application utilizing a continuous pattern 60 on one member(s) and an intermittent pattern 61 on one other mating member(s) will incorporate automatic venting. This allows for internal pressure(s) to be relieved and internal gases to escape through the voids evident in the intermittent bonding pattern. Also to further improve venting through the bonding intermittent pattern, small cuts 62 in the substrate, perpendicular to the bonding pattern(s) 60, 61 greater length and/or the edge of bonding panel(s) 32, 34 or upstanding walls 14, 18 to which bonding material(s) have been applied. Should internal pressure(s) or gases be excessive the container outer most member substrate lacking bonding material application, and cut as heretofore mentioned, would be allowed to open or lift. Also, of note, the bonding material on the food packaging container is to the outside, or externally placed, away from the food containment so as to prevent contamination during heating or reheating. Should it be further desirable with discreet containment(s) a tear edge can be introduced which would prevent bonding material contact. Prior art environments utilize these methods in other food packaging containers.

When packaging certain food(s) and using certain bonding materials, an aesthetically desired design limitation resides in insuring that the longitudinal edge of the emulsion pattern is spaced from the fold line which connects the extended bonding panel to the upstanding wall(s) of the mating embodiment.

The desirability of insuring that the interior edge of the emulsion pattern does not extend to the fold line of the bonding panel arises from the fact that if the bonding material employed is a pressure sensitive emulsion and the emulsion pattern did, infact, extend to or past the bonding panel fold line, food packaged within the container may adhere to the lid or cover when the lid, or cover was removed.

With respect to the bonding materials which may be employed, it has been determined that an FDA approved cohesive type emulsion lends itself best to the fast food environment(s) while heat activated, pressure sensitive, aqueous emulsion(s) are acceptable for particular environments. Other determinate factors in regard to bonding material(s) would be the method employed to construct the embodiment(s); the method of emulsion application; the required bonding strength of embodiment member(s) in the constructed container; environment container utilization and containment; criteria previously confronted in prior art of food packaging containers.

The use of a FDA approved cohesive emulsion(s) is desirable when the lid, or cover, is manually affixed to the major body embodiment characteristically praticed in the fast food, pizza, or bakery environments. It would have the same basic characteristic of a self-sealing envelope and would eliminate(s) the need for a secondary bonding, or binding. For example, binding with a string, or a piece of tape for cover retainment. A food packaging container with equivalent capacities and constructed in accordance with my invention will have adequate bonding strength without secondary retention; utilize less substrate materials, in some cases as much as 25% less, than a comparible capacity container used in the heretofore discussed environment(s).

Another method of bonding would utilize coated substrate that would be heat sealed, or ultra-sonically fixed, preferably a class of thermoplastic material which posses properties that permit their use both as a coating and barrier material as well as a bonding material using polyvinyl acetate as an example, the substrate may be coated therwith and utilized to construct an embodiment of my invention, and subsequently an embodiment constructed of a polyethylene coated substrate may be heat sealed one to one other and a heat sensitive bonding connection would result.

Alternate embodiment(s) of my invention is shown in FIGS. 11, 13, 14, 17, 18 which illustrates the configuration of various shaped, other than square, containers. The utilization of square shaped embodiment(s) to be set side by side and covered with a square or rectangular shaped embodiment which has been inverted then utilized as a cover lends itself to compartmentation of a food packaging container FIG. 18, 19 whereby one embodiment(s) would contain a vegetable while the other embodiment(s) would contain a meat product then married to each other through the use of a common lid or cover.

Figure 6:
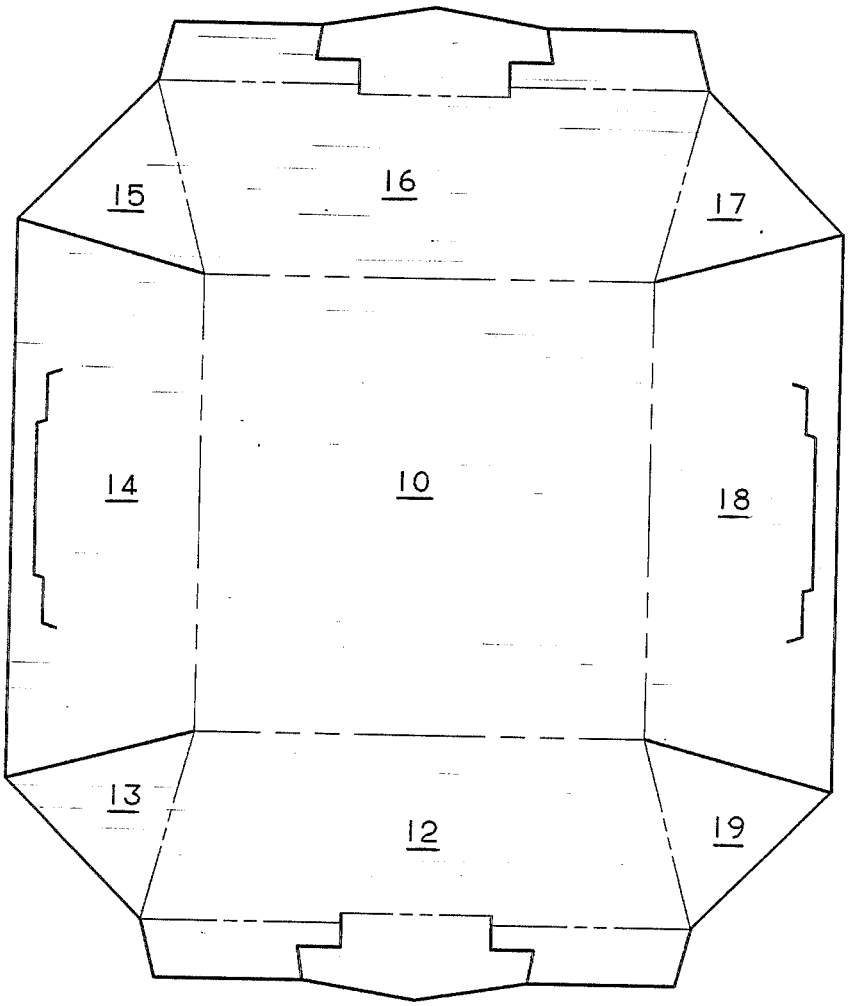
FIG. 6 is a plan view of a blank having a plurality of scored and cut line(s), male insert tab(s), and female insert tab slot(s), which may be erected to form a major body, or tray, of the type shown in FIG. 1.
Figure 7:
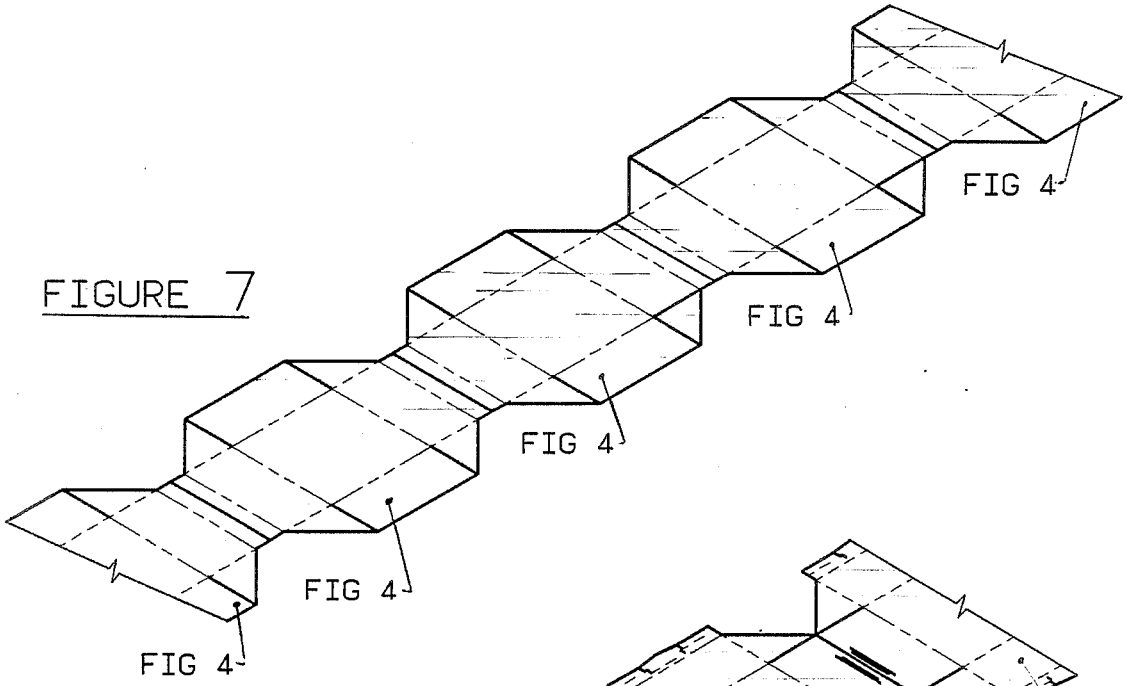
FIG.7 is a view, in perspective, of a continuous web of a die-cut and scored blank(s) of the type shown in FIG. 4.
Figure 8:
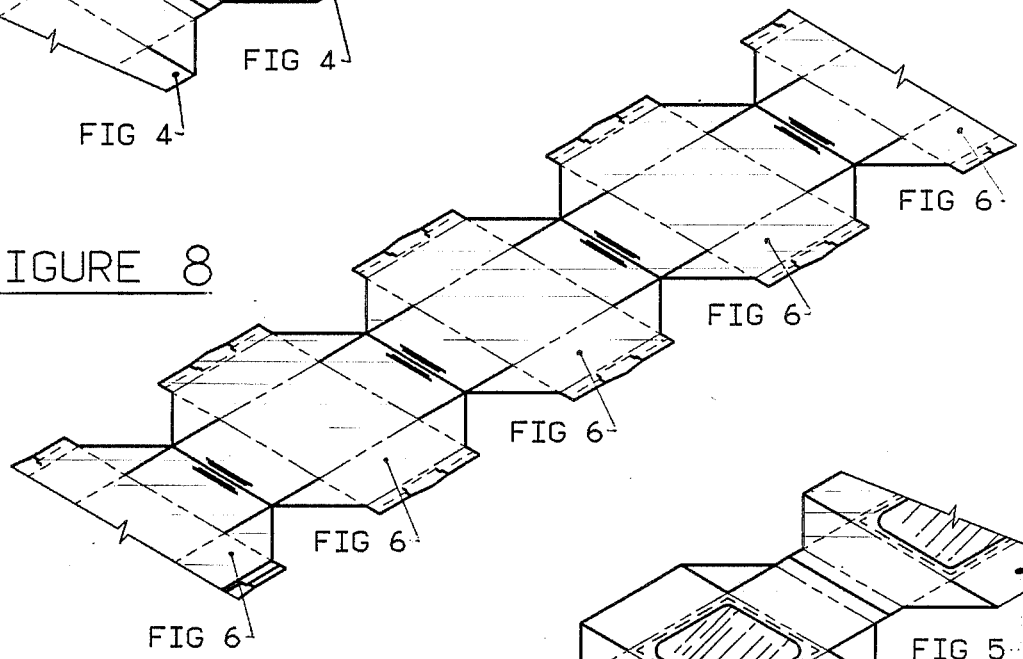
FIG. 8 is a view, in perspective, of a continuous web of a scored, and die-cut blank(s) that include die-cut tab(s) and slot(s) of the type shown in FIG. 6.
Figure 9:
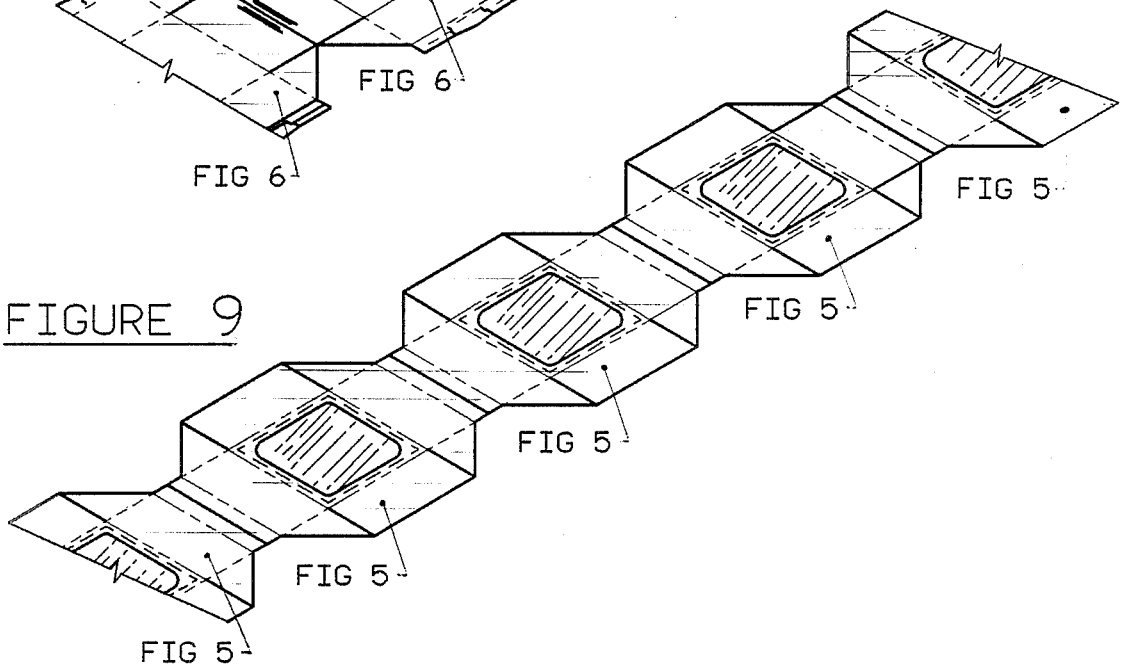
FIG. 9 is a view, in perspective, of a continuous web of a scored, and die-cut blank(s) that include(s) die-cut opening(s) with a clear substrate applied as a window of the type shown in FIG. 5.
Figure 11:
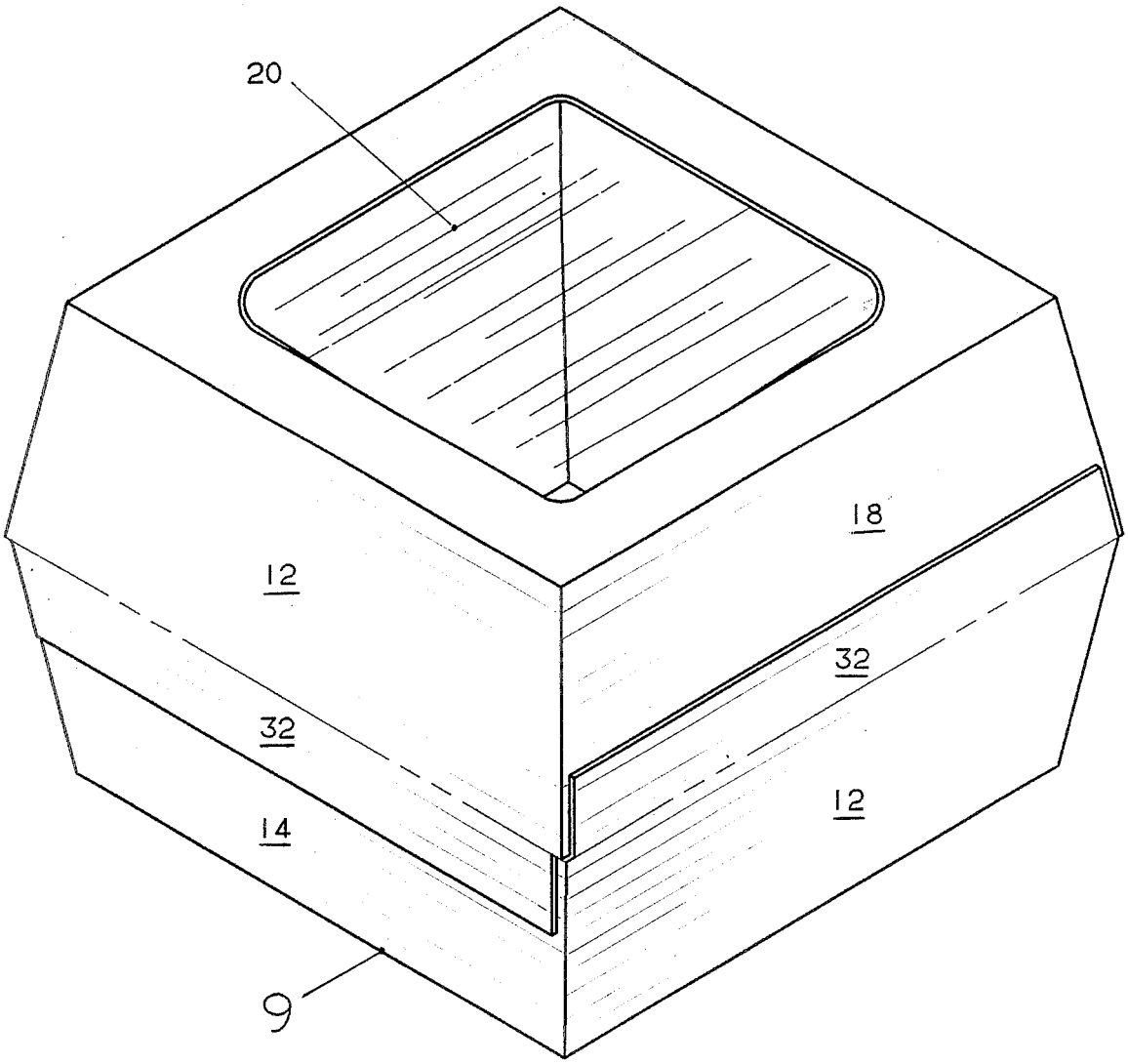
FIG. 11 is a view, in perspective, which in combination of a major body, or tray, as shown in FIG. 1 and a major body, or tray, utilized as a cover with a window to construct an embodiment of my invention.
Figure 13:
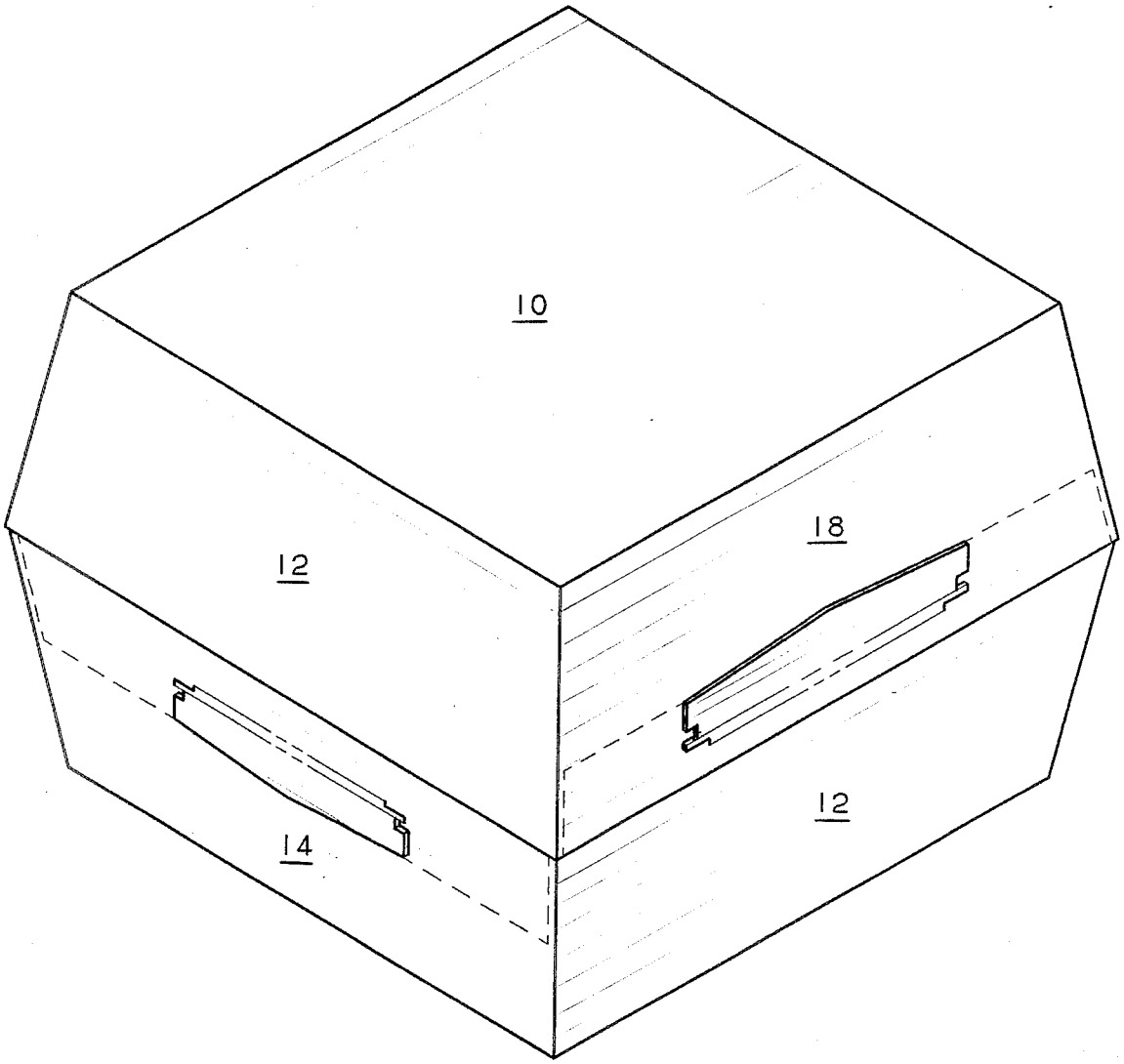
FIG. 13 is a view, in perspective, of an embodiment which is mechanically bound, through the use of tabs & slots, to construct an embodiment of my invention.

The embodiments of FIGS. 6, 12, and 13 show an interlocking tab and slot construction as an alternative to the adhesive flap constructions previously described. The FIG. 6 embodiment includes lock tabs hinged to walls 12, 16 with flaps extending from walls 12, 16 on lateral sides thereof. The embodiment of FIGS. 12 and 13 differs from the embodiment of FIG. 6 in tht the lock tabs are hinged to the flaps as opposed to the walls 12, 16. The walls 14, 18 include cuts configured to receive the tabs from a like cover. In attaching the cover to the bottom, the tabs and adjacent flaps are pushed to the inside and the tabs extend through the slots to the outside as depicted in FIG. 13. Once the tabs and flaps are positioned interiorly of the walls of the container cover and bottom, the outwardly angled walls will guide the lock tabs into engagement with the cuts as the cover and bottom are pushed together.

Also, by using a container, constructed of an embodiment(s) of my invention, utilizing an ovenable substrate should lend itself quite readily in environment(s) requiring large quantities of hot prepared food(s). For example a food packaging container constructed of ovenable board would be utilized in dispersing pizza(s), of various sizes, at sporting event(s).

Considering the construction of an embodiment(s) of my invention many environment(s) could utilize the container for multiple applications, as it lends itself to feature(s) that would benefit end users. For example: it can be dispensed directly from a roll and formed manually with ease; dispensed as a pre-cut blank(s) and formed rapidly with ease; or erected in advance, nested one into one other and open at the top FIG. 1 for filling; with additional utilization of an embodiment(s) member as a tray, or eating utensil; and the utilization of an embodiment member(s) as a major body and one other embodiment member(s) as a lid or cover to form a container, with the same relative ease of self-sealing envelope through the use and application of a cohesive emulsion to the substrate used to construct an embodiment of my invention.

Although my invention has hereinbefore been described by reference to a number of illustrative embodiments, it will be appreciated that other container constructions may be devised which are nevertheless within the scope of my invention as defined by the claims appended hereto:

I claim:

1. A container for packaging and heating food comprising:

a. a bottom tray and a separately formed cover, each of said bottom tray and cover including: 1. a base portion, 2. walls attached to said base portion and forming a containment area therebetween, means attaching said walls to each other, 3. a bonding panel secured by a foldline to an edge of each of one pair of said walls and having a releasable adhesive thereon for securing the bottom tray and cover together and for repeated opening and closing of said container.

b. at least one of said bonding panels having an unbonded area forming a vent to release pressure from the interior to the exterior of said container, said at least one bonding panel further including cuts forming a bending area adjacent said foldline in said at least one bonding panel and in line with said unbonded area, said bending area allowing release of excessive pressure in said container.

2. The container of claim 1 wherein the walls slope outward from said base portions and away from each other thereby permitting nesting of the cover and bottom tray when not in use.

3. The container of claim 1 wherein at least some of said walls other than the pairs of walls have releasable adhesive thereon adapted to be secured to said releasable adhesive on said bonding panels during securement of the cover to the bottom tray.

4. A container for packaging and heating food comprising:

a. a plurality of bottom trays and a separately formed cover each said bottom tray comprising: 1. a base portion, 2. upstanding walls attached to said baase portion, means attaching said walls to each other, 3. a bonding panel extending upwardly from an edge of each of one pair of said walls and having a releasable adhesive thereon;

b. said cover comprising: 1. a base portion, 2. walls extending downwardly from said cover base portion, 3. a bonding panel extending downwardly from an edge of each of one pair of said walls and having a releasable adhesive thereon;

c. said cover having an area between said cover walls substantially equal to the total area between the bottom tray walls of all said bottom trays thereby allowing said bottom trays to be secured together and closed using said bottom tray bonding panels and said cover bonding panels.

5. The container of claim 4 wherein at least some of said walls other than the pairs of walls have releasable adhesive thereon adapted to be secured to said releasable adhesive on said bonding panels during securement of the cover to the bottom trays.

6. A container for packaging and heating food comprising:

a. a bottom tray and a separately formed cover, each of said bottom tray and cover including: 1. a base portions, 2. walls attached to said base portion and forming a containment area therebetween, means attaching said walls to each other, 3. a flap secured to each one of a pair of said walls along a foldline, a lock tab cut from each said flap and hinged to one of said flaps and said respective wall, 4. cuts formed within another pair of said walls and adapted to lockingly receive said lock tabs formed in an opposing one of said bottom trays and cover;

b. said cover walls extending downwardly and otuwardly away from said cover base portion, said bottom tray walls extending upwardly and outwardly from said bottom tray base portion;

c. said lock tabs and flaps being positioned interiorly of said walls when said cover and bottom tray are secured whereby said walls will guide said lock tabs into engagement with said slits when secured.

* * * * *